US005541045A

United States Patent [19]

Takahashi et al.

[11] Patent Number: 5,541,045

[45] Date of Patent: Jul. 30, 1996

[54] SILVER HALIDE PHOTOGRAPHIC MATERIAL

[75] Inventors: Osamu Takahashi; Masakazu Morigaki, both of Minami-ashigara, Japan

[73] Assignee: Fuji Photo Film Co., Ltd., Kanagawa, Japan

[21] Appl. No.: 323,668

[22] Filed: Oct. 17, 1994

[30] Foreign Application Priority Data

Oct. 19, 1993 [JP] Japan ..... 5-283829

[51] Int. Cl.[6] ..... G03C 1/46

[52] U.S. Cl. ..... 430/505; 430/558; 430/512; 430/931; 430/607; 430/613

[58] Field of Search ..... 430/505, 558, 430/512, 931, 607, 613

[56] References Cited

U.S. PATENT DOCUMENTS

| | | | |
|---|---|---|---|
| 3,061,432 | 10/1962 | Menzel et al. | 430/376 |
| 3,843,371 | 10/1974 | Puler et al. | 430/512 |
| 4,500,630 | 2/1985 | Sato et al. | 430/386 |
| 4,665,015 | 5/1987 | Iijima et al. | 430/558 |
| 4,840,886 | 6/1989 | Iijima et al. | 43/558 |
| 5,451,501 | 9/1995 | Mizukawa et al. | 430/558 |

*Primary Examiner*—Geraldine Letscher
*Attorney, Agent, or Firm*—Birch, Stewart, Kolasch & Birch, LLP

[57] ABSTRACT

Disclosed is a silver halide color photographic material containing at least one pyrazolotriazole magenta of formula (I) and at least one 1,3,5-triazine compound of formula (II) in the same photographic constitutive layer.

(I)

wherein R represents a hydrogen atom or a substituent; Za, Zb and Zc each represent a methine group, a substituted methine group, =N— or —NH—; Y represents a hydrogen atom or a group capable of splitting off from the formula by coupling reaction with an oxidation product of a developing agent; and the formula may form a dimer or a higher polymer via R, Y or the substituted methine group for Za, Zb or Zc.

(II)

wherein A, B and C each represent a substituted or unsubstituted alkyl, substituted or unsubstituted aryl, substituted or unsubstituted alkoxy, substituted or unsubstituted aryloxy or substituted or unsubstituted heterocyclic group, provided that at least one of A, B and C represents a group of a general formula (III):

(III)

wherein $R_1'$ and $R_2'$ each represent a hydrogen atom, a halogen atom, or a substituted or unsubstituted alkyl, substituted or unsubstituted cycloalkyl, substituted or unsubstituted aryl, substituted or unsubstituted alkoxy or substituted or unsubstituted aryloxy group.

27 Claims, No Drawings

SILVER HALIDE PHOTOGRAPHIC MATERIAL

FIELD OF THE INVENTION

The present invention relates to a silver halide photographic material and, more precisely, to a silver halide color photographic material which has excellent color reproducibility, excellent light-fastness from low-density area to high-density area and improved yellow stains.

BACKGROUND OF THE INVENTION

In general, color images to be obtained by photographic processing of silver halide color photographic materials are composed of azomethine dyes or indoaniline dyes to be formed by reaction of oxidation products of aromatic primary amine developing agents and couplers.

To obtain color photographic images with good color reproducibility, needed are clear dyes having a small side absorption. Dyes to be formed from 5-pyrazolone magenta couplers which are popularly used for forming magenta dyes have a side absorption at about 430 nm in addition to its main absorption at about 550 nm, and therefore such couplers are not favorable in view of their color reproducibility. In order to overcome the problem, various studies have heretofore been made.

For instance, dyes to be formed from pyrazoloazole magenta couplers described in U.S. Pat. Nos. 3,061,432 and 4,500,630 have a much more reduced side absorption at about 430 nm than those to be formed from 5-pyrazolone magenta couplers. Therefore, the former couplers are preferred in view of their color reproducibility. In addition, they have another advantage in that they cause noticeably reduced yellow stains (hereinafter referred to as Y-stains) in the non-colored white background area under heat and moisture.

However, even the above-mentioned couplers capable of forming dyes having a small side absorption are still unsatisfactory because of the following two drawbacks which are desired to be overcome. The first is that the light fastness in the colored area having a low density is extremely inferior to that in the colored area having a high density; and the second is that they often cause Y-stains in the non-exposed white background area in light. In this way, if the fading rate differs between the low density area and the high density area and if Y-stains are formed in the non-exposed area, the commercial value of the photographic materials containing them is noticeably lowered. In particular, photographic pictures are stored under various conditions these days. For instance, some are stored for display. Therefore, it is strongly desired to obtain fast color images which do not have Y-stains even when exposed to light and which are fast everywhere irrespective of their color densities.

As one means for preventing the formation of Y-stains in light, for example, there has been proposed the use of bisphenols in JP-A 52-7222 (the term "JP-A" as used herein means an "unexamined published Japanese patent application"). They are surely effective for 3-anilino-5-pyrazolone magenta couplers. However, when they are applied to the above-mentioned pyrazolotriazole magenta couplers, they do not have the Y-stain inhibiting effect but, on the contrary, some of them increase Y-stains.

The present inventors have noted that when 2-(2'-hydroxyphenyl)benzotriazole compounds or benzophenone compounds known as ultraviolet absorbents are added to interlayers and silver halide emulsion layers positioned upper than magenta coupler-containing layers, then the light fastness of the colored area having a low density is improved and the formation of Y-stains is inhibited to some degree due to the UV-cutting effect of the compound(s) added. However, even though the amount of the compounds to be added is increased, their effect obtained is limited.

SUMMARY OF THE INVENTION

The present invention has been made in consideration of the above-mentioned problems and its object is to provide a silver halide color photographic material which has excellent color reproducibility and excellent light fastness everywhere from its low-density area and its high-density area and which has few Y-stains.

Another object of the present invention is to provide a method for forming a color photographic image having such high image quality as mentioned above.

The above-mentioned objects of the present invention have been attained by a silver halide color photographic material having at least one photographic constitutive layer on a support, wherein the photographic constitutive layer contains at least one compound of the following general formula (I) and at least one compound of the following general formula (II) in the same layer:

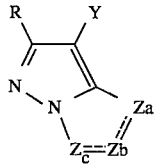

(I)

wherein R represents a hydrogen atom or a substituent; Za, Zb and Zc each represent a methine group, a substituted methine group, =N— or —NH—;

Y represents a hydrogen atom or a group capable of splitting off from the formula by coupling reaction with an oxidation product of a developing agent; and the formula may form a dimer or a higher polymer via R, Y or the substituted methine group for Za, Zb or Zc. Formula (II):

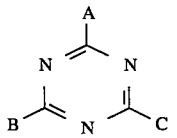

(II)

wherein A, B and C each represent a substituted or unsubstituted alkyl, substituted or unsubstituted aryl, substituted or unsubstituted alkoxy, substituted or unsubstituted aryloxy or substituted or unsubstituted heterocyclic group, provided that at least one of A, B and C represents a group of a general formula (III):

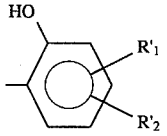

(III)

in which $R_1'$ and $R_2'$ each represent a hydrogen atom, a halogen atom, or a substituted or unsubstituted alkyl, substituted or unsubstituted cycloalkyl, substituted or unsubstituted aryl, substituted or unsubstituted alkoxy or substituted or unsubstituted aryloxy group.

DETAILED DESCRIPTION OF THE INVENTION

The photographic material of the present invention containing at least one compound of formula (II) in the photographic constitutive layer containing one or more magenta couplers of formula (I), provides a color image having high light fastness everywhere from its low-density area to its high-density area while Y-stains to be formed in the white background area in light are inhibited. Light fastness and Y-stains in processed photographic materials are both provided by light to be applied to the materials. Therefore, it may be considered that the compounds of formula (II) are added to the layers positioned upper than those containing the magenta couplers so as to cut ultraviolet rays. According to the present invention, however, the compound(s) of formula (II) is/are added to the same layer containing the coupler(s) of formula (I), by which the photographic material has the unexpectedly remarkable effects mentioned above. From this, it is understood that the compounds of formula (II) do not act merely to cut ultraviolet rays.

Of couplers of formula (I), preferred are those of the following general formulae (Ia), (Ib), (Ic), (Id) and (Ie):

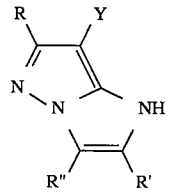
(Ia)

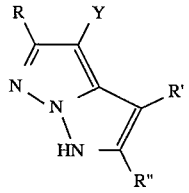
(Ib)

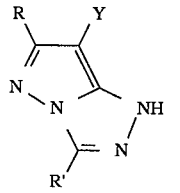
(Ic)

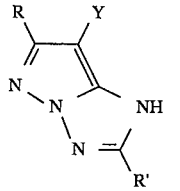
(Id)

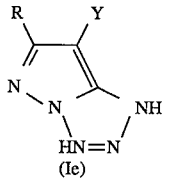
(Ie)

(Ie)

The substituents in these formulae (Ia) to (Ie) will be explained in detail hereunder. R, R' and R" each represent an aliphatic group, an aromatic group, or a heterocyclic group.

The aliphatic group preferably has 1 to 32 carbon atoms, including carbon atoms contained in the substituted group thereof and includes a substituted or unsubstituted, linear or branched alkyl group, a substituted or unsubstituted aralkyl group, a substituted or unsubstituted alkenyl group, a substituted or unsubstituted alkynyl group, a substituted or unsubstituted cycloalkyl group, a substituted or unsubstituted cycloalkenyl group, for example, methyl group, ethyl group, propyl group, t-butyl group, trifluoromethyl group, tridecyl group, 2-methanesulfonylethyl group, 3-(3-pentadecylphenoxy)propyl group, 3-(4-{2-[4-(4-hydroxyphenylsulfonyl)phenoxy]dodecanamido}phenyl)propyl group, 2-ethoxytridecyl group, trifluoromethyl group, cyclopentyl group, 3-(2,4-di-t-amylphenoxy) propyl group.

The aromatic group preferably has 6 to 32 carbon atoms, including carbon atoms contained in the substituted group thereof, and includes a substituted or unsubstituted phenyl group and a substituted or unsubstituted naphthyl group, for example, phenyl group, 4-t-butylhphenyl group, 2,4-di-t-amylphenyl group, 4-tetradecanamidohphenyl group.

The heterocyclic group preferably comprises 5- or 6-membered ring and preferably contains at least one atom of N, O and S, for example, 2-furyl group, 2-thienyl group, 2-pyrimidinyl group, and 2-benzothiazoryl group.

The aliphatic group, aromatic group, heterocyclic group and coupling split-off group represented by R, R' and R" each may optionally be substituted by substituent (s) chosen from among an alkyl group having 1 to 32 carbon atoms, an aryl group having 6 to 32 carbon atoms, a heterocyclic group, an alkoxy group (e.g., methoxy, 2-methoxyethoxy), an aryloxy group (e.g., 2,4 -di-tert-amylphenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, methanesulfonamido, dipropylsulfamoylamino), a carbamoyl group (e.g., dimethylcarbamoyl, ethylcarbamoyl), a sulfamoyl group (e.g., butylsulfamoyl), an imido group (e.g., succinimido, hydantoinyl), an ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxyl group, a cyano group, a carboxyl group, a nitro group, a sulfo group, a halogen atom, etc. R, R' and R" each may also be R'''O—, R'''C(=O)—, R'''CO(=O)—, R'''S—, R'''SO—, R'''$SO_2$—, R'''$SO_2$NH—, R'''C(=O)NH—, R'''NH—, R'''OC(=O)NH—, a hydrogen atom, a halogen atom, a cyano group, or an imido group. R'''means an alkyl group, an aryl group or a heterocyclic group.

R, R' and R" each may also be a carbamoyl group, a sulfamoyl group, an ureido group or a sulfamoylamino group, in which the nitrogen atom(s) may optionally be substituted by substituent(s) chosen from among those mentioned above for R, R' and R". Of these substituents, preferred are a linear alkyl group, a branched alkyl group, a cycloalkyl group, an aryl group, an alkoxy group, an aryloxy group and an ureido group.

Y has the same meaning as that defined in formula (I).

Where Y represents a group capable of being split off from the formula by coupling reaction with an oxidation product of a developing agent ( hereinafter referred to as a "coupling split-off group"), the group includes, for example, a group linking the coupling-active carbon atom to an aliphatic group, an aromatic group, a heterocyclic group, an aliphatic, aromatic or heterocyclic sulfonyl group, or an aliphatic, aromatic or heterocyclic carbonyl group, via an oxygen, nitrogen or sulfur atom (the nitrogen atom may be one existing in the heterocyclic group), as well as a halogen atom and an aromatic azo group. The aliphatic, aromatic or heterocyclic moiety in the coupling split-off group may optionally be substituted by substituent (s) such as those mentioned above for R, R' and R".

As specific examples of the coupling split-off group, mentioned are a halogen atom (e.g., fluorine, chlorine, bromine), an alkoxy group (e.g., ethoxy, dodecyloxy, methoxyethoxy, carboxypropyloxy, methylsulfonylethoxy), an aryloxy group (e.g., phenoxy, 4-methylphenoxy, 4-tert-butylphenoxy, 4-methoxycarbonylphenoxy, 4-ethoxycarbonylphenoxy, 4-carboxyphenoxy, 4-cyanophenoxy, 2,4-dimethylphenoxy, 4-chlorophenoxy, 4-methoxyphenoxy, 4-carboxyphenoxy), an acyloxy group (e.g., acetoxy, tetradecanoyloxy, benzoyloxy), an aliphatic or aromatic sulfonyloxy group (e.g., methanesulfonyloxy, toluenesulfonyloxy), an acylamino group (e.g., dichloroacetylamino, heptafluorobutyrylamino), an aliphatic or aromatic sulfonamido group (e.g., methanesulfonamido, p-toluenesulfonamido), an alkoxycarbonyloxy group (e.g., ethoxycarbonyloxy, benzyloxycarbonyloxy), an aryloxycarbonyloxy group (e.g., phenoxycarbonyloxy), an aliphatic, aromatic or heterocyclic thio group (e.g., ethylthio, phenylthio, tetrazolylthio), a carbamoylamino group (e.g., N-methylcarbamoylamino, N-phenylcarbamoylamino), a 5-membered or 6-membered nitrogen-containing heterocyclic group (e.g., imidazolyl, pyrazolyl, triazolyl, tetrazolyl, 1,2-dihydro-2-oxo-1-pyridyl), an imido group (e.g., succinimido, hydantoinyl), an aromatic azo group (e.g., phenylazo), etc. The coupling split-off group may have a photographically-useful group derived from a development inhibitor, a development accelerator, a desilvering accelerator, etc. Of the above-mentioned groups, especially preferred are a halogen atom and an aryloxy group.

Of couplers of formulae (Ia) to (Ie), those of formulae (Ic) and (Id) are preferred in view of the effect of the present invention.

Especially preferred are those of formulae (Ic) and (Id) wherein R is a tertiary alkyl group and R' is a substituted alkyl group or an aryl group.

Of couplers of formula (I) for use in the present invention, most preferred are those of the following general formula (If):

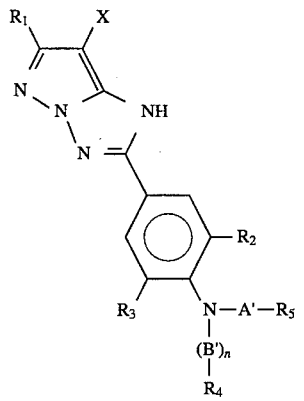

(If)

wherein $R_1$ represents a tertiary alkyl group; $R_2$ and $R_3$ each represent a hydrogen atom or a substituent; X represents a halogen atom or an aryloxy group; A' and B' each represent —CO— or —$SO_2$—; n represents 0 or 1; $R_4$ represents a hydrogen atom, an alkyl group or an aryl group; $R_5$ represents an alkyl group preferably having 1 to 32 carbon atoms including carbon atoms in a substituent thereof, an aryl group preferably having 6 to 32 carbon atoms including carbon atoms in a substituent thereof, an alkoxy group preferably having 1 to 32 carbon atoms including carbon atoms in a substituent thereof, an alkylamino group preferably having 1 to 32 carbon atoms including carbon atoms in a substituent thereof or an arylamino group preferably having 6 to 32 carbon atoms including carbon atoms in a substituent thereof; and $R_4$ and $R_5$ may be bonded each other to form a 5-membered, 6-membered or 7-membered ring.

Couplers of formula (If) will be described in more detail hereunder.

$R_1$ represents a tertiary alkyl group which may optionally have substituent(s) or in which the branches may be bonded to each other to form a ring. Therefore, the terminology "branched alkyl group" as referred to herein and hereafter broadly includes a cycloalkyl group. As the substituents for the group, if substituted by them, for example, preferred are a halogen atom (e.g., fluorine, chlorine), an alkoxy group (e.g., methoxy, ethoxy, dodecyloxy), an aryloxy group (e.g., phenoxy, 2-methoxyphenoxy, 4-t-octylphenoxy), an alkylthio group (e.g., methylthio, ethylthio, octylthio, hexadecylthio), an arylthio group (e.g., phenylthio, 2-pivaloylphenylthio, 2-butoxy-5-t-octylphenylthio), an ester group (e.g., methyl ester, ethyl ester), a cyano group, etc. As the branched alkyl group of $R_1$ where the branches are bonded each other to form a ring, mentioned are a 1-methylcyclopropyl group, a 1-ethylcyclopropyl group, an adamantyl group, etc. $R_1$ is most preferably a t-butyl group.

$R_2$ and $R_3$ may be the same or different and each represent a hydrogen atom or a substituent. As preferred examples of the substituent, mentioned are a cyano group, a hydroxyl group, a carboxyl group, a halogen atom (e.g., fluorine, chlorine, bromine), an alkyl group (including a branched alkyl group, such as methyl, ethyl, propyl, butyl, t-butyl), an aryl group (e.g., phenyl ), an alkoxy group (e.g., methoxy, ethoxy, propyloxy, butoxy, dodecyloxy), an aryloxy group (e.g., phenoxy, 4-methoxyphenoxy, 2-methoxyphenoxy, 4-methylphenoxy, 4-chlorophenoxy, 4-tert-butylphenoxy, 2,4-dimethylphenoxy), an alkoxycarbonyl group (e.g., methoxycarbonyl, ethoxycarbonyl, octyloxycarbonyl, hexadecyloxycarbonyl), a carbamoyl group (e.g., N-ethylcarbamoyl, N-dodecylcarbamoyl, N,N-dibutylcarbamoyl, N-cyclohexylcarbamoyl, N-phenylcarbamoyl), a sulfamoyl group (e.g., N-ethylsulfamoyl, N-butylsulfamoyl, N-octylsulfamoyl, N-hexadecylsulfamoyl, N-cyclohexylsulfamoyl, N,N-dibutylsulfamoyl, N-methyl-N-octadecylsulfamoyl), etc.

More preferred for use in the present invention are couplers of formula (If) in which $R_2$ is a hydrogen atom, and $R_3$ is a hydrogen atom, an alkyl group or an alkoxy group. Most preferred are those in which $R_2$ and $R_3$ are both hydrogen atoms.

$R_4$ in formula (If) represents a hydrogen atom, an alkyl group or an aryl group. The alkyl group means a substituted or unsubstituted, linear or branched alkyl group and preferably has 1 to 32 carbon atoms including carbon atoms in the substituent thereof. The examples of the alkyl group include, for example, methyl group, ethyl group, propyl group, t-butyl group, trifluoromethyl group, tridecyl group, 2-methanesulfonylethyl group, 3-(3-pentadecylphenoxy)propyl group, 3-(4-{2-{4-(4-hydroxyphenylsulfonyl)phenoxy] dodecanamido}phenyl)propyl group, 2-ethoxytridecyl group, trifluoromethyl group, cyclopentyl group, 3-(2,4-di-t-amylphenoxy)propyl group. As examples of the substituents for the substituted alkyl group, mentioned are a halogen atom (e.g., fluorine, chlorine, bromine), a hydroxyl group, a cyano group, a carboxyl group, an aryl group (e.g., phenyl, naphthyl), an alkoxy group (e.g., methoxy, ethoxy, propyloxy, butoxy, dodecyloxy, 2-methoxyethoxy, 2-phenoxyethoxy), an aryloxy group (e.g., phenoxy, 2-methoxyphenoxy, 4-methylphenoxy, 4-methoxyphenoxy, 2,4-dimethylphenoxy, 2,4-di-tertamylphenoxy, 4-tert-octylphenoxy, 4-cyanophenoxy, 2 -chloro-4-tert-octylphenoxy, 4-methanesulfonamidophenoxy), an alkylthio group (e.g., methylthio, ethylthio, butylthio, octylthio, dodecylthio, hexadecylthio, 2-ethylhexylthio, 2-phenoxyethylthio), an arylthio group (e.g., phenylthio, 2-pivaloylamidophenylthio, 4-tert-octylphenylthio, 4-dodecyloxyphenylthio, 2-butoxy-4-tert-octylphenylthio), an carbonyloxy group (e.g., methoxycarbonyl, ethoxycarbonyl, propyloxycarbonyl, butoxycarbonyl, octyloxycarbonyl, dodecyloxycarbonyl, hexadecyloxycarbonyl, 2-methoxyethoxycarbonyl), a carbonyloxy group (e.g., acetyloxy, propionyloxy, dodecanoyloxy, hexadecanoyloxy), an amido group (e.g., acetamido, propanamido, butanamido, dodecanamido, hexadecanamido, benzamido, 2-dodecyloxybenzamido), a sulfonamido group (e.g., methanesulfonamido, ethanesulfonamido, octanesulfonamido, hexadecansulfonamido, benzenesulfonamido, 2-octyloxy-4-tert-octylbenzenesulfonamido, 2-hexadecyloxycarbonylbenzenesulfonamido, 3-hexadecyloxycarbonylbenzenesulfonamido, 3-dodecyloxycarbonylbenzenesulfonamido), a carbamoyl group (e.g., N-methylcarbamoyl, N-butylcarbamoyl, N-cyclohexylcarbamoyl, N-dodecylcarbamoyl, N-phenylcarbamoyl, N,N-ethylcarbamoyl, N,N-dibutylcarbamoyl), a sulfamoyl group (e.g., N-ethylsulfamoyl, N-butylsulfamoyl, N-hexadecylsulfamoyl, N-cyclohexylsulfamoyl, N,N-dibutylsulfamoyl, N-phenylsulfamoyl, N-methyl-N-octadecylsulfamoyl), an imido group (e.g., succinimido, phthalimido, hexadecylsuccinimido, octadecylsuccinimido), an urethane group (e.g., methylurethane, ethylurethane, dodecylurethane, phenylurethane), an ureido group (e.g., N-methylureido, N-ethylureido, N-dodecylureido, N,N-dibutylureido, N-phenylureido, N-cyclohexylureido), a sulfonyl group (e.g., methylsulfonyl, ethylsulfonyl, propylsulfonyl, butylsulfonyl, hexylsulfonyl, octylsulfonyl, dodecylsulfonyl, hexadecylsulfonyl, phenylsulfonyl), etc.

The aryl group means a substituted or unsubstituted aryl group, preferably having 6 to 32 carbon atoms including carbon atoms in a substituent thereof, and include, for example, phenyl group, 4-t-butyl-phenyl group, 2,4-di-t-amylphenyl group and 4-tetradecanamidophenyl group. The substituents for the substituted aryl group have the same meanings as those for the substituted alkyl group of $R_3$ mentioned above.

$R_5$ in formula (If) represents an alkyl group, an aryl group, an alkoxy group, an alkylamino group or an arylamino group. The alkyl group has the same meanings as mentioned with respect to $R_4$. As examples of the substituents for the substituted alkyl group, the same as those mentioned above for the substituted alkyl group $R_4$ are referred to. As the alkyl group, preferred are a branched, substituted or unsubstituted alkyl group and a linear substituted alkyl group, in view of the solubility of the couplers. The aryl group of $R_5$ has the same meanings as mentioned with respect to $R_4$. As examples of the substituents for the substituted aryl group, the same as those mentioned above for the substituted aryl group $R_4$ are referred to. The alkoxy group of $R_5$ means a substituted or unsubstituted, linear or branched alkyloxy group, preferably having 1 to 32 carbon atoms including carbon atoms in a substituent thereof. As examples of the substituents for the substituted alkyloxy group, the same as those mentioned above for the substituted alkyloxy group $R_4$ are referred to. The alkylamino group of $R_5$ means a substituted or unsubstituted, linear or branched alkylamino group, preferably having 1 to 32 carbon atoms including carbon atoms in a substituent thereof. As examples of the substituents for the substituted alkylamino group, the same as those mentioned above for the substituted alkyl group $R_4$ are referred to. The arylamino group of $R_5$ means a substituted or unsubstituted arylamino group, preferably having 6 to 32 carbon atoms including carbon atoms in a substituent thereof. As examples of the substituents for the substituted arylamino group, the same as those mentioned above for the substituted alkyl group $R_4$ are referred to. A' and B' each represent —CO— or —$SO_2$—, and n represents 0 or 1. A' is preferably —$SO_2$—.

$R_4$ and $R_5$ may be bonded to each other to form a 5-membered, 6-membered or 7-membered ring. Specific examples of the 5-membered, 6-membered and 7-membered rings are mentioned below, which, however, are not limitative.

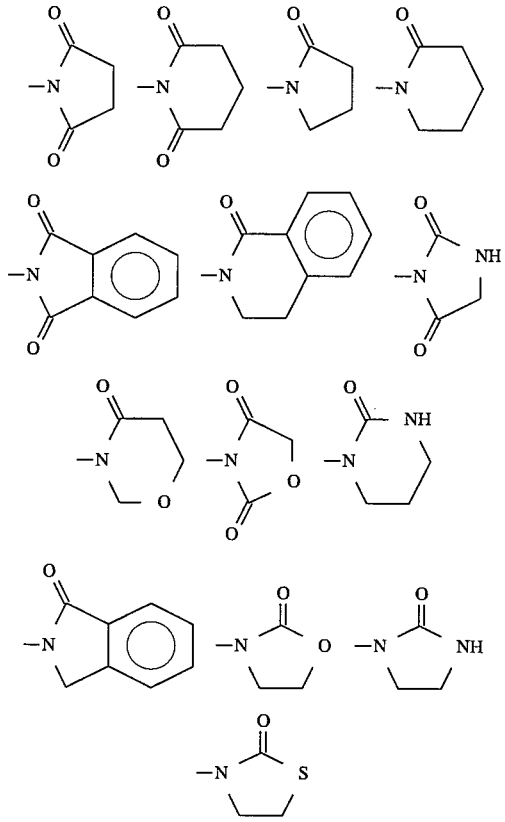

These 5-membered, 6-membered and 7-membered rings may have substituent(s) thereon. As examples of the substituents, those mentioned above for $R_2$ and $R_3$ are referred to.

Where $R_4$ and $R_5$ are bonded to each other, they preferably form an imido ring or a lactam ring. More preferably, they are not bonded to each other. n is preferably 0. Most preferably, n is 0 and $R_4$ is a hydrogen atom.

X in formula (If) represents a halogen atom or an aryloxy group. X is split off from the coupler of formula (If), when the coupler is coupled with an oxidation product of a developing agent. The halogen atom includes, for example, fluorine, chlorine and bromine atoms. The aryloxy group means a substituted or unsubstituted aryloxy group. As the substituents for the substituted aryloxy group, those mentioned above for the substituted alkyl group of $R_4$ are referred to. The aryloxy group includes, for example, a phenoxy group, a 4-methylphenoxy group, a 4-tert-butylphenoxy group, 4-methoxycarbonylphenoxy group, a 4-ethoxycarbonylphenoxy group, a 4-carboxyphenoxy group, a 4-cyanophenoxy group, a 2,4-dimethylphenoxy group, etc. X is preferably a halogen atom, most preferably a chlorine atom.

Specific examples of typical magenta couplers for use in the present invention are mentioned below, which, however, are not intended to restrict the scope of the present invention.

M-1
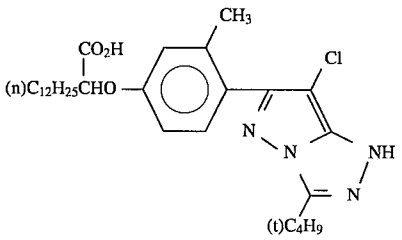
M-2
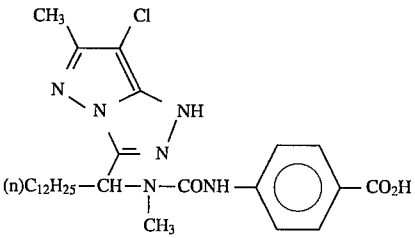
M-3
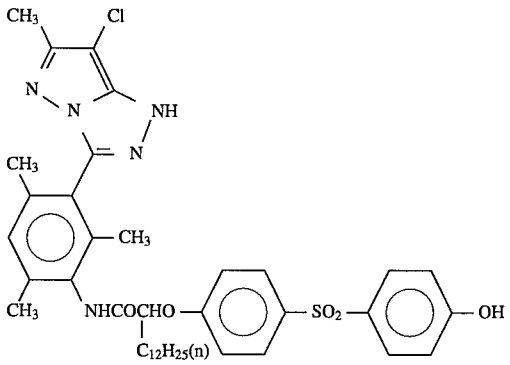

-continued
M-4
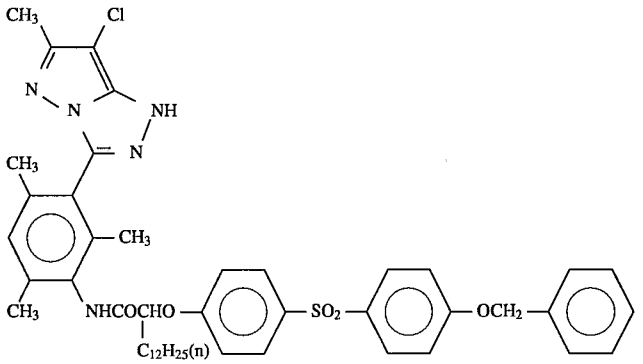
M-5
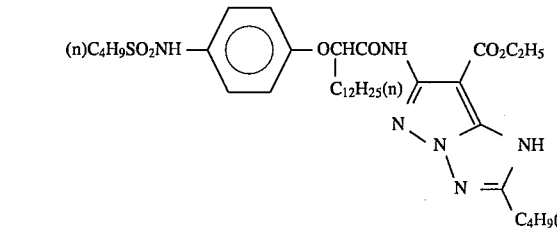
M-6
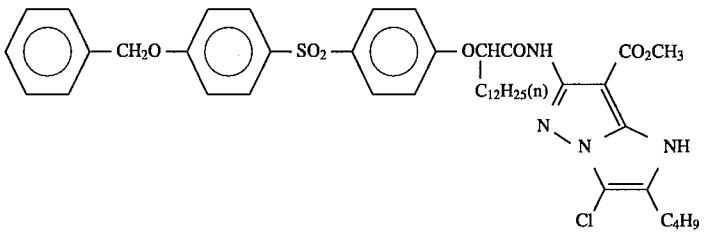
M-7
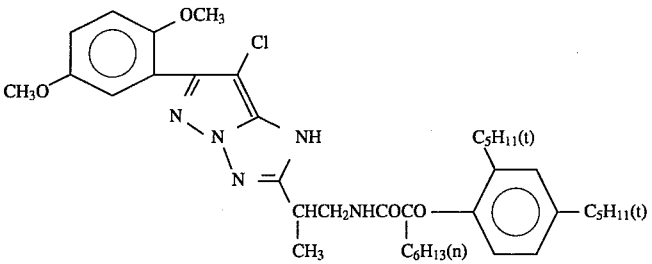

-continued
| | |
|---|---|
| M-8 | 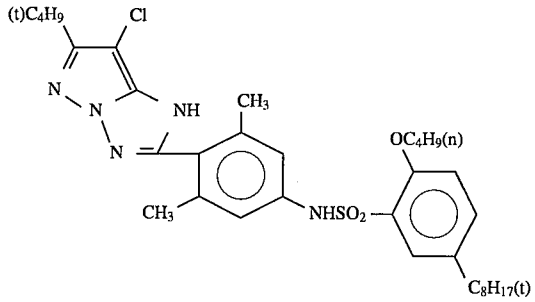 |
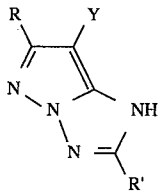
| Compound | R | R' | Y |
|---|---|---|---|
| M-9 | $CH_3-$ | 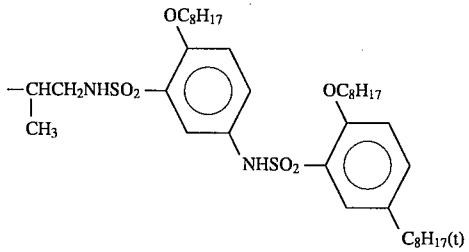 | Cl |
| M-10 | " | 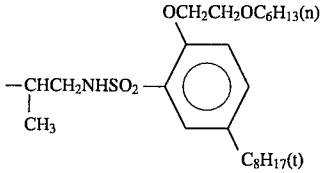 | " |

-continued
| | | | |
|---|---|---|---|
| M-11 | $(CH_3)_3C-$ | 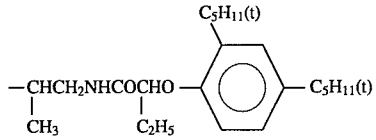 | 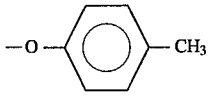 |
| M-12 | 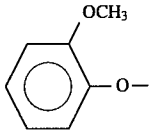 | 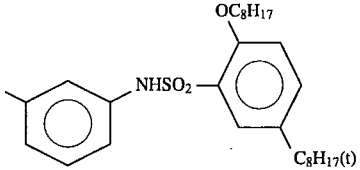 | 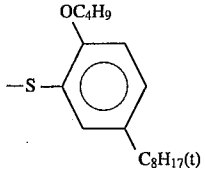 |
| M-13 | $CH_3-$ | 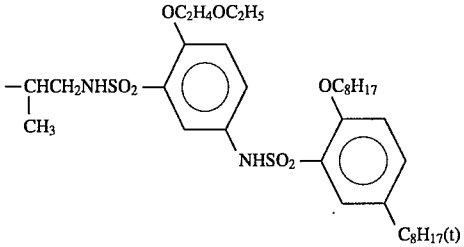 | Cl |
| M-14 | " | 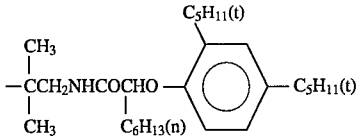 | " |
| M-15 | " | 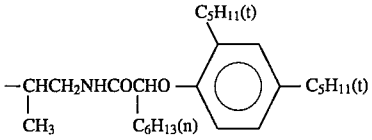 | " |
| M-16 | $CH_3-$ | 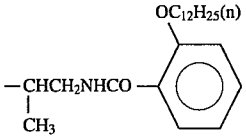 | Cl |

-continued
| | | | |
|---|---|---|---|
| M-17 | " | 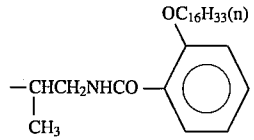 | " |
| M-18 | 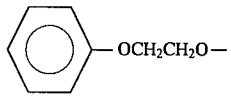 | 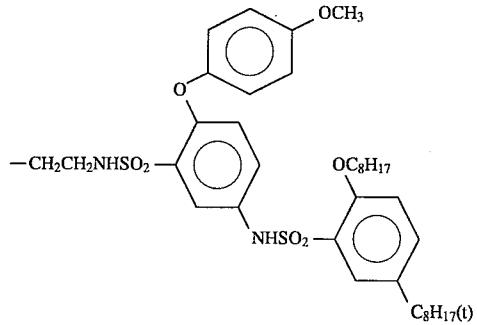 | 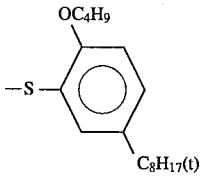 |
| M-19 | $CH_3CH_2O-$ | " | " |
| M-20 | 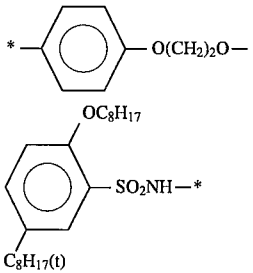 | 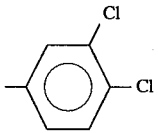 | 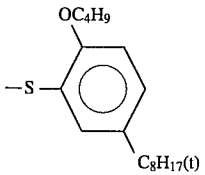 |
| M-21 | 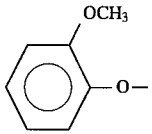 | 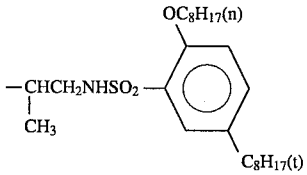 | Cl |

-continued
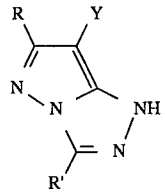
| Compound | R | R' | Y |
|---|---|---|---|
| M-22 | $CH_3-$ | 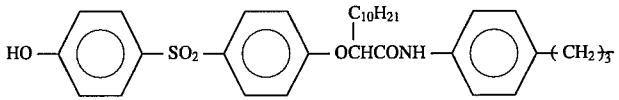 | Cl |
| M-23 | " | 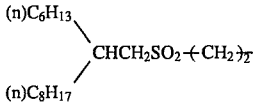 | " |
| M-24 | 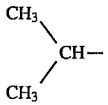 | 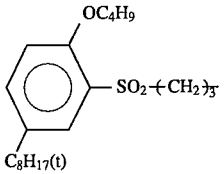 | " |
| M-25 | 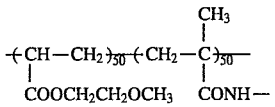 | 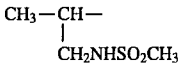 | " |
| M-26 | 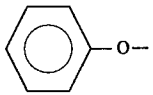 | 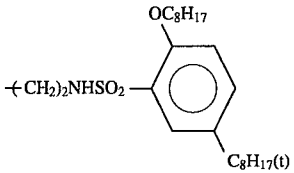 | Cl |

-continued
| | | | |
|---|---|---|---|
| M-27 | $CH_3-$ | 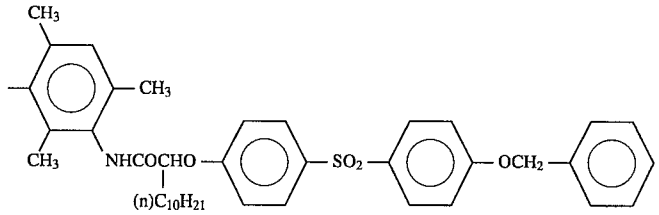 | " |
| M-28 | $(CH_3)_3C-$ | 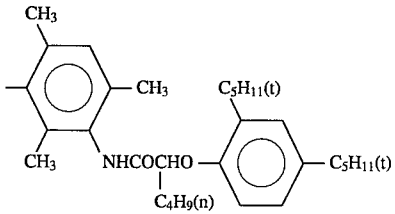 | " |
| M-29 | 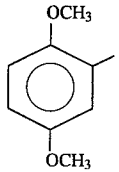 | 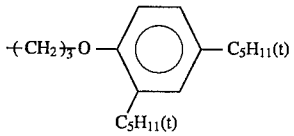 | Cl |
| M-30 | $CH_3-$ | 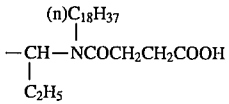 | " |
| M-31 | | 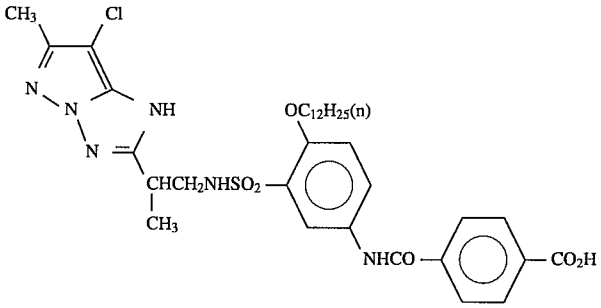 | |

-continued
M-32
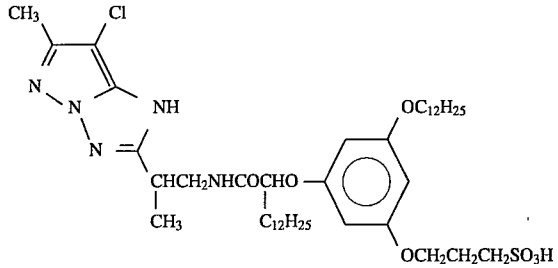
M-33
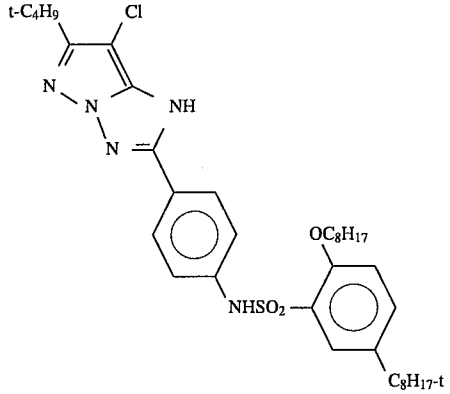
M-34
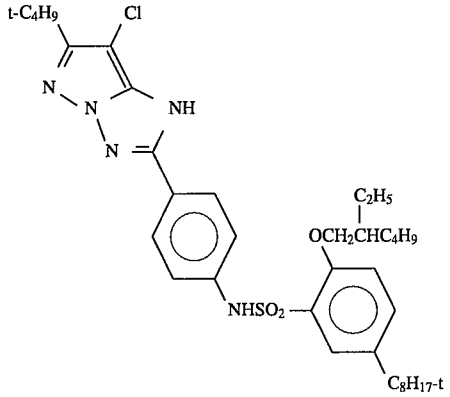

-continued
M-35
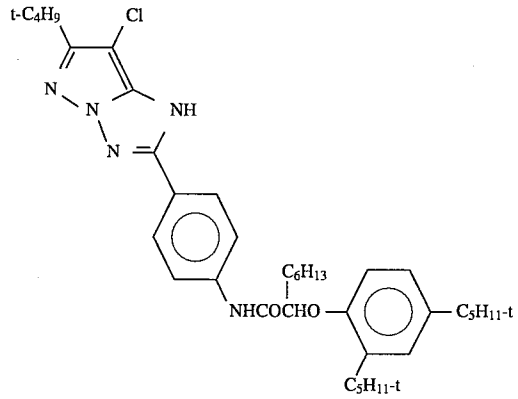
M-36
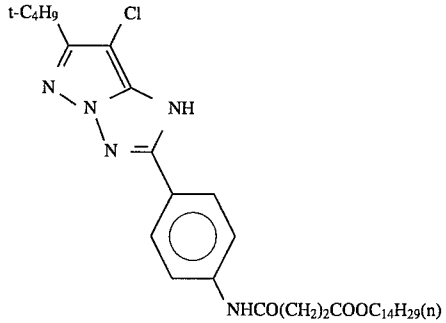
M-37
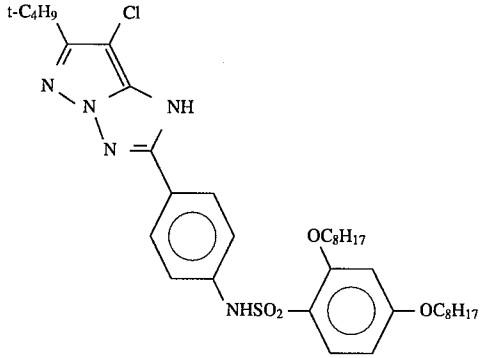

-continued
M-38
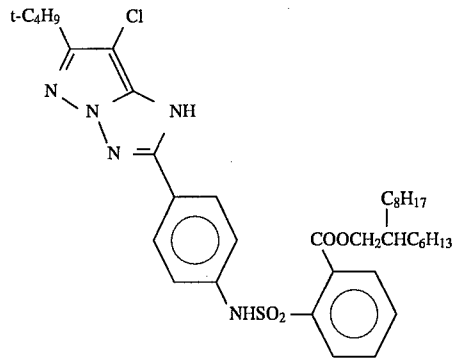
M-39
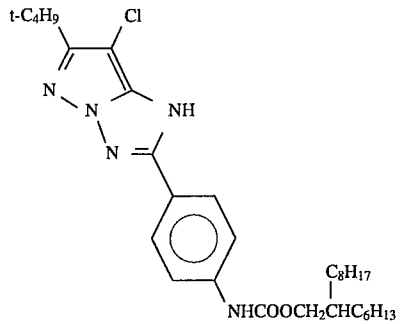
M-40
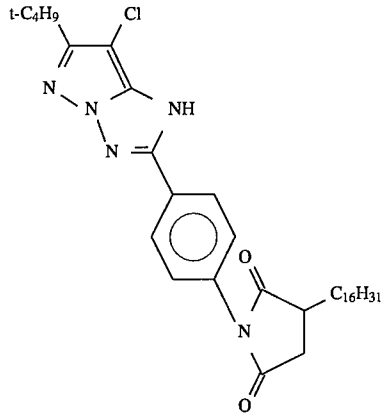

-continued
M-41
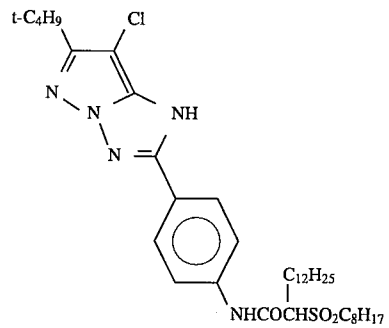
M-42
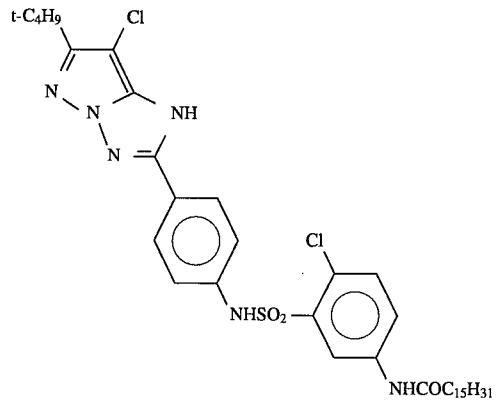
M-43
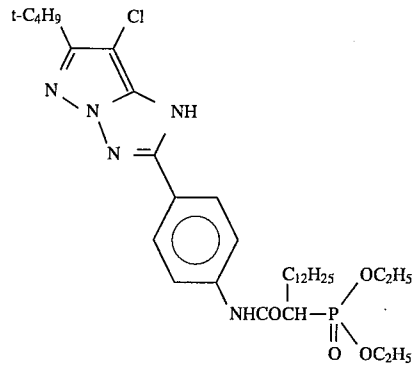

-continued
M-44
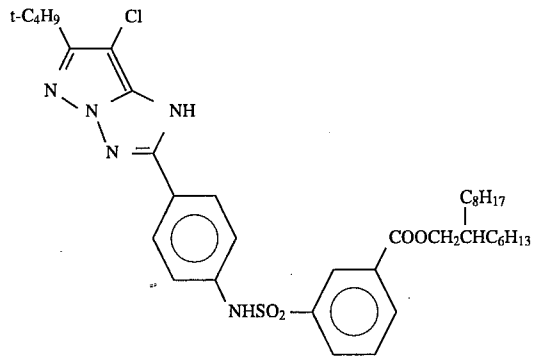
M-45
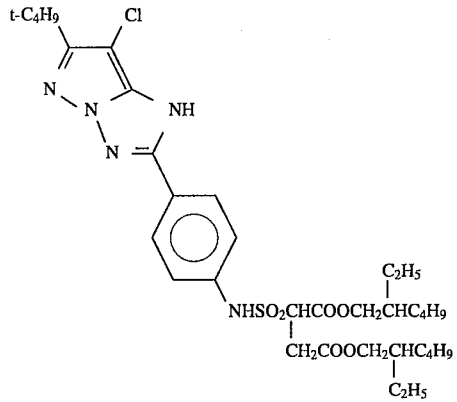

-continued
M-46
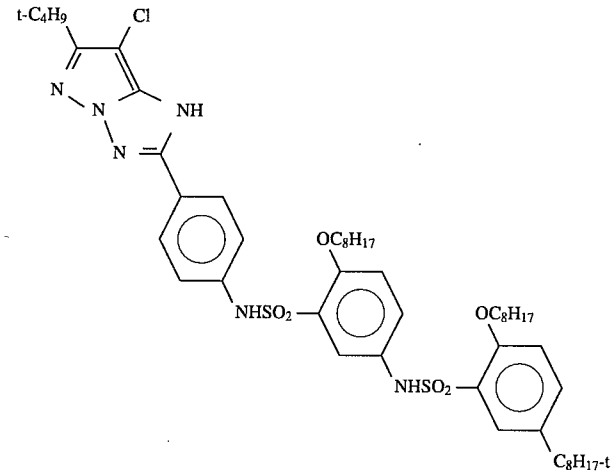
M-47
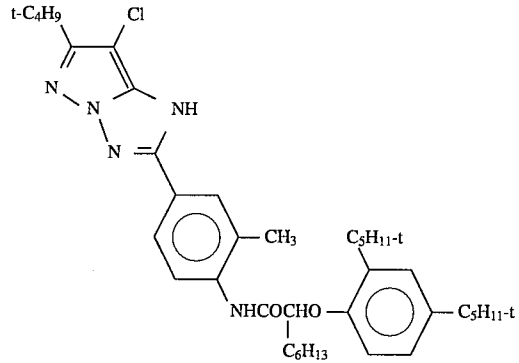

-continued
M-48
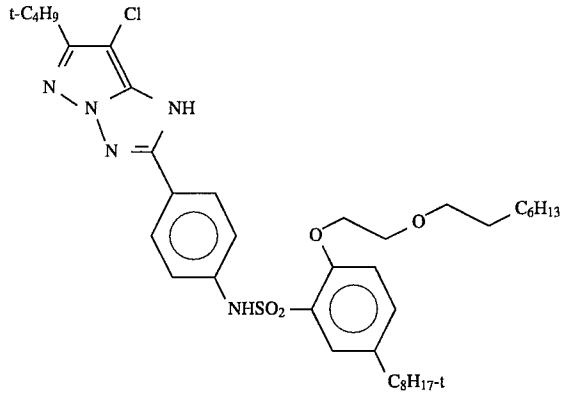
M-49
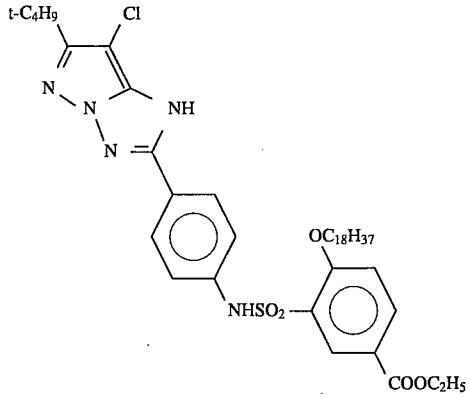

-continued
M-50
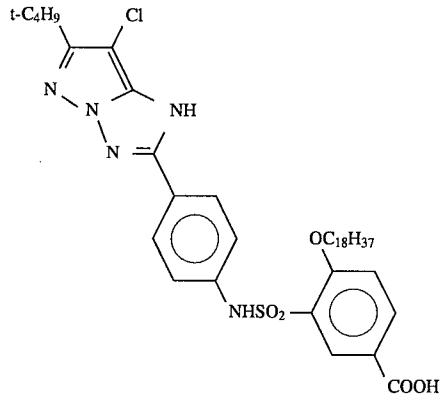
M-51
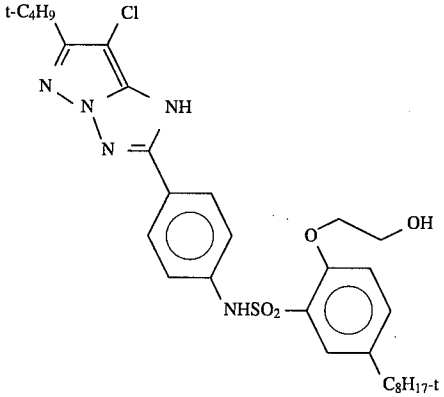

-continued
M-52
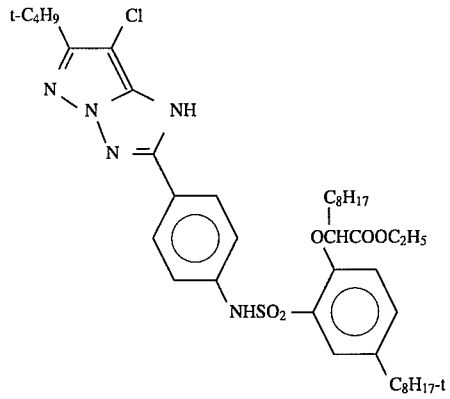
M-53
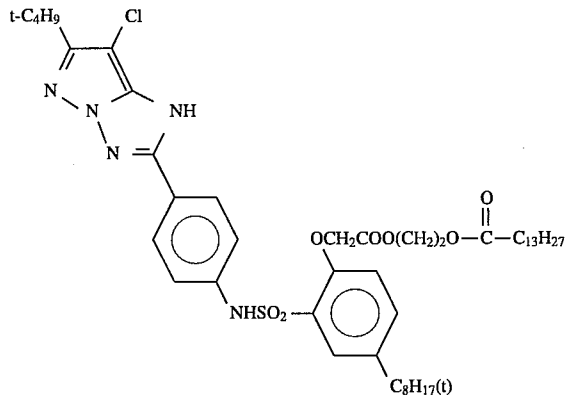

-continued
M-54
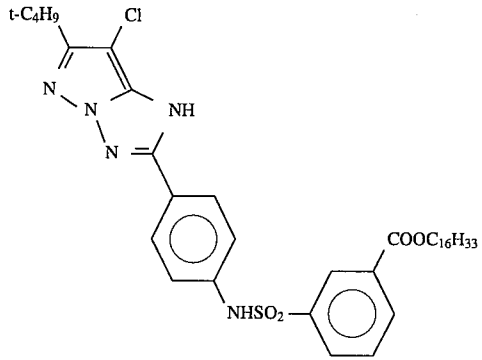
M-55
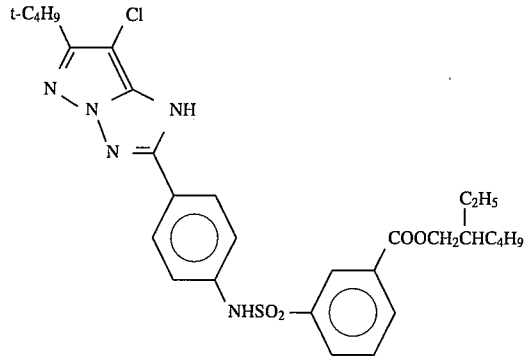
M-56
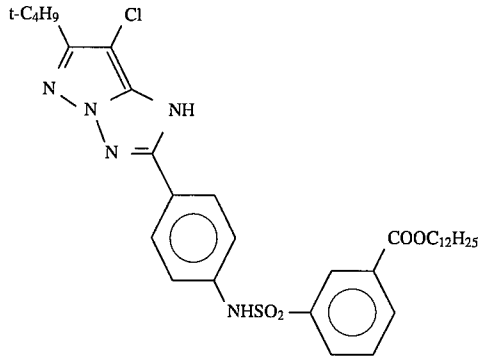

-continued
M-57
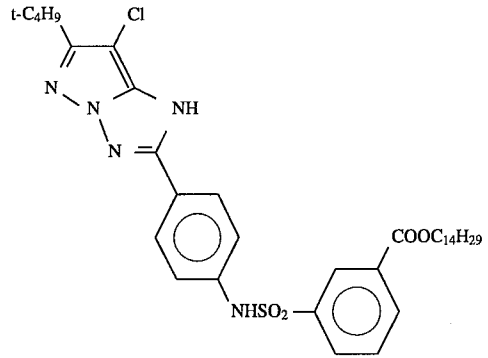
M-58
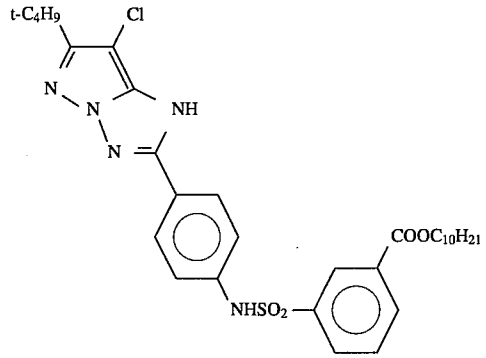
M-59
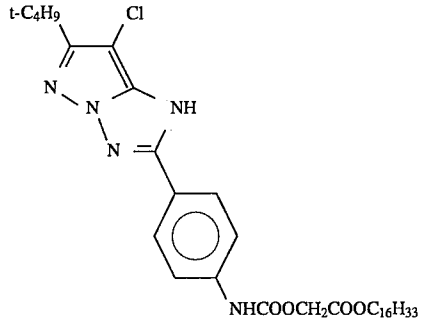

-continued
M-60
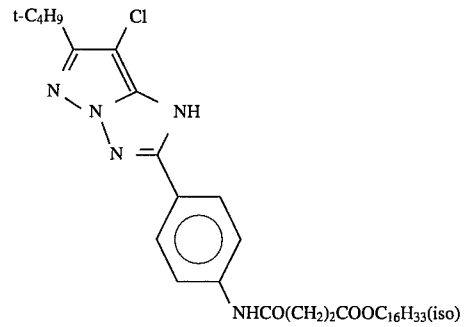
M-61
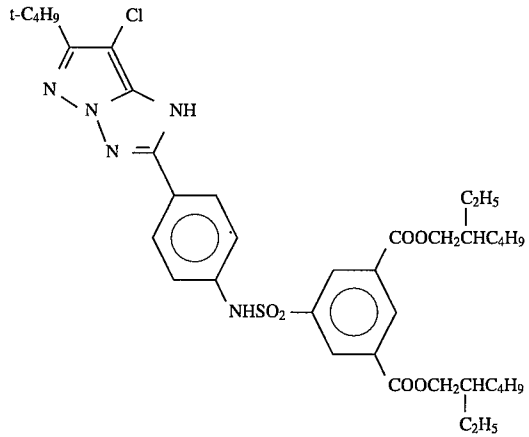

-continued
M-62
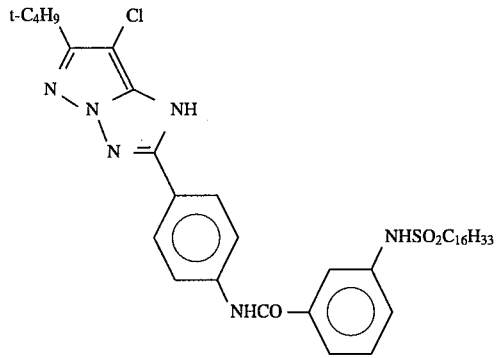
M-63
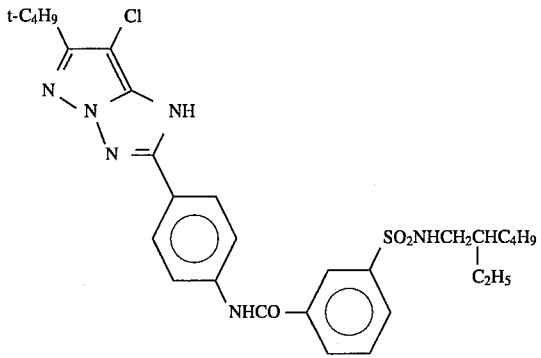
M-64
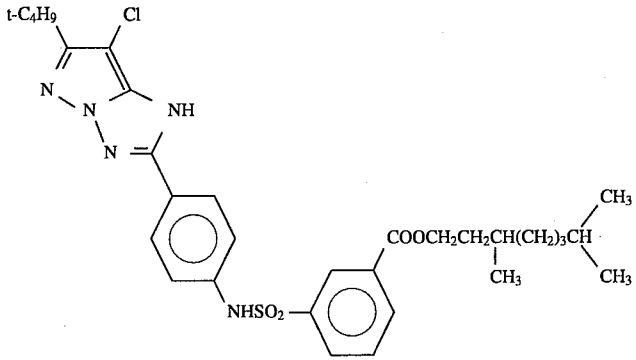

-continued
M-65
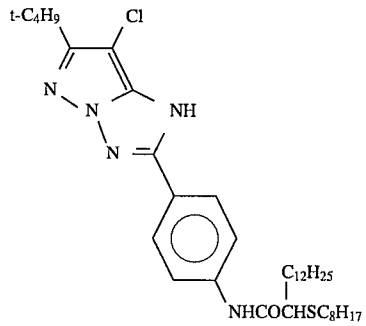
M-66
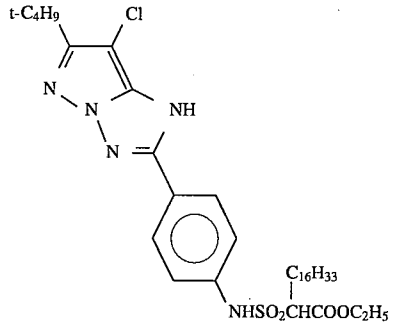
M-67
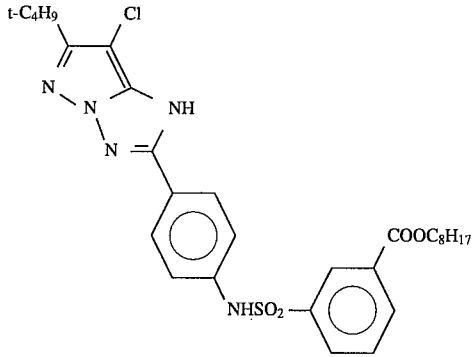

-continued
M-68
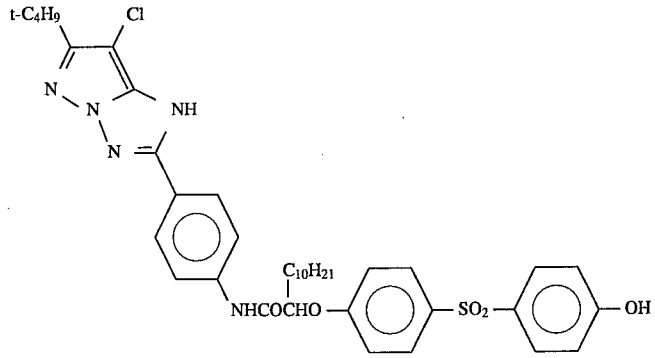
M-69
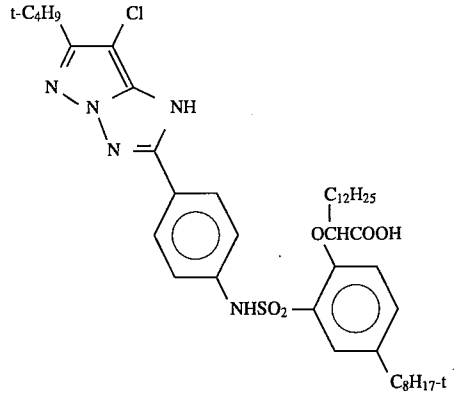

-continued
M-70
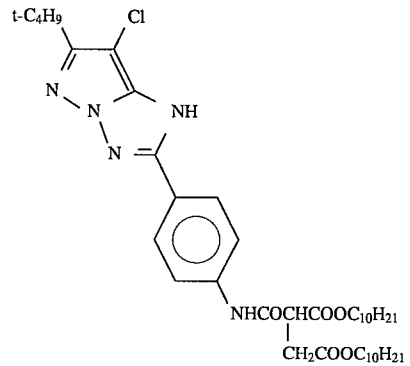
M-71
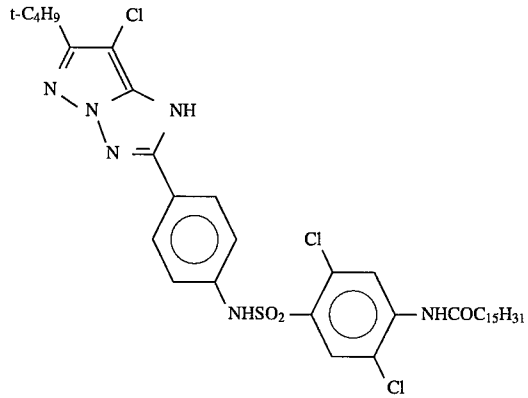

-continued
M-72
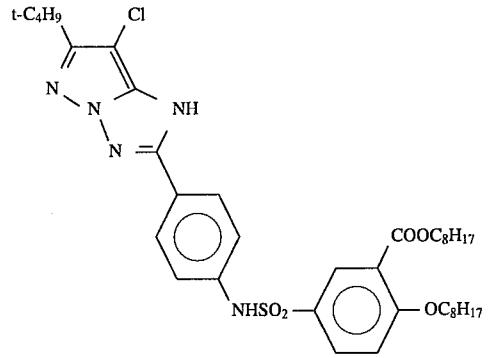
M-73
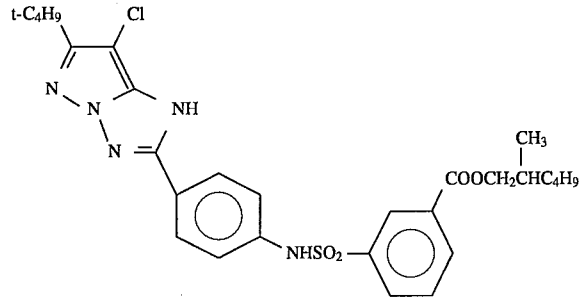
M-74
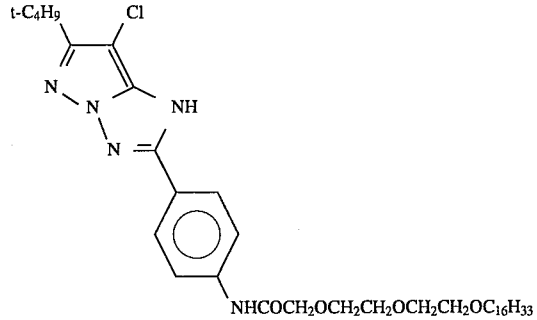

-continued
M-75
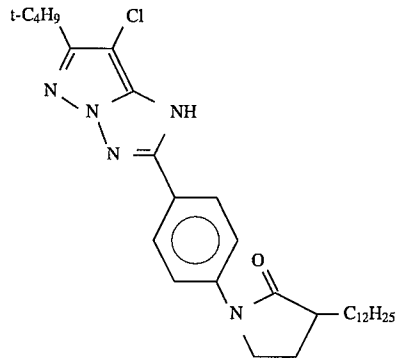
M-76
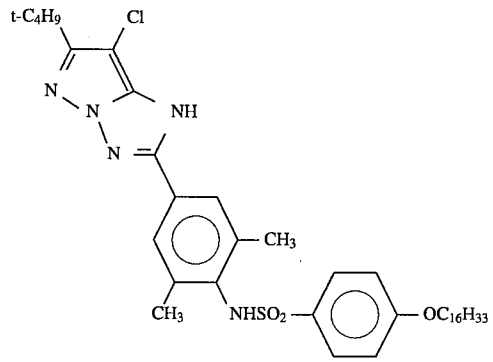
M-77
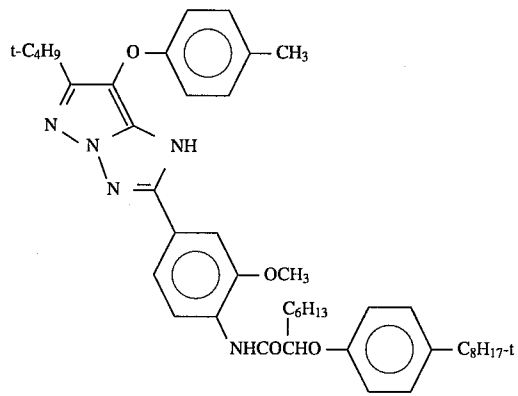

-continued
M-78
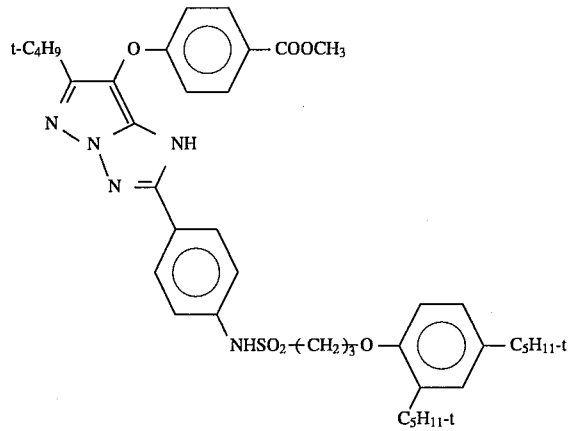
M-79
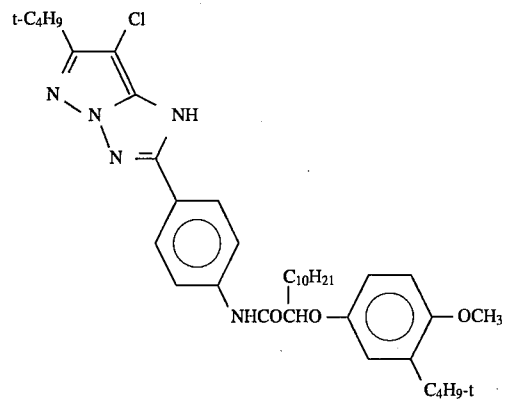

-continued
M-80
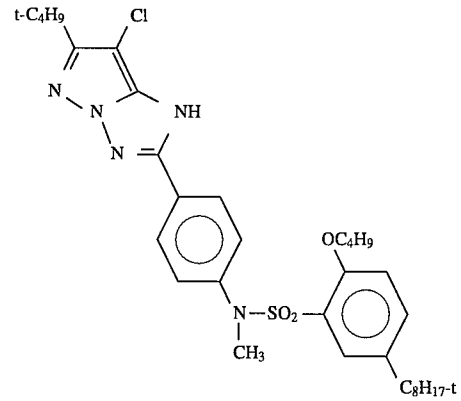
M-81
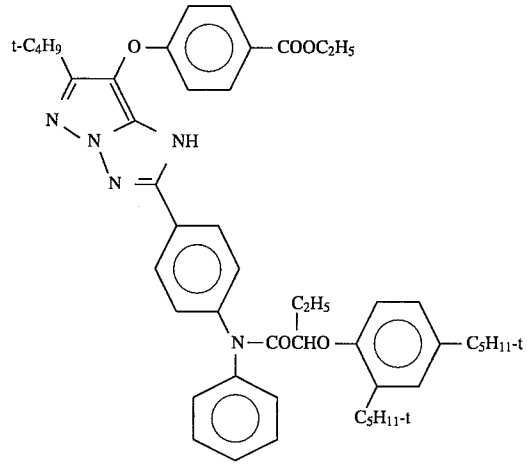

-continued
M-82
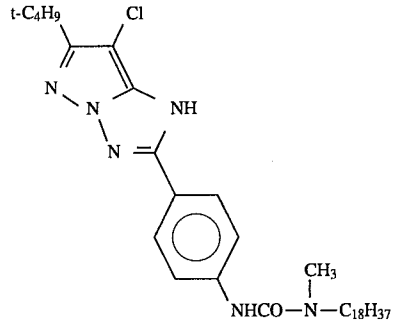
M-83
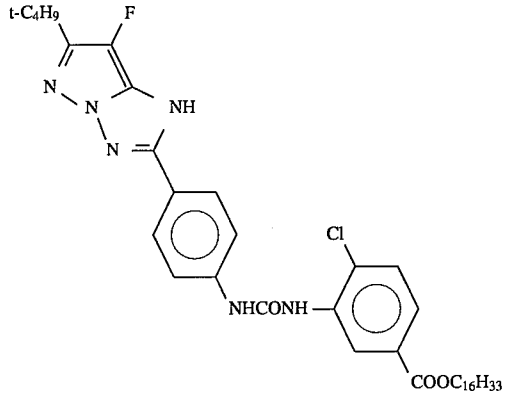
M-84
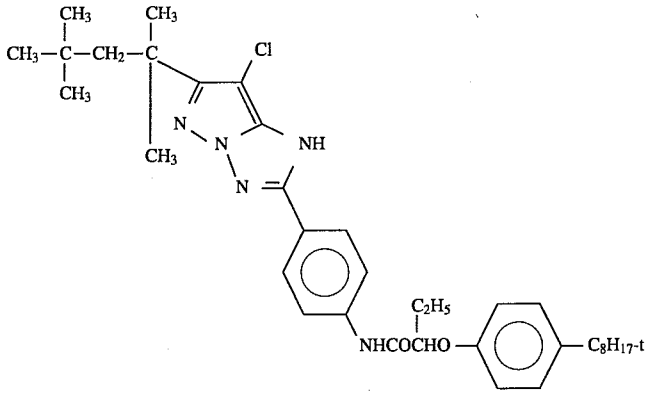

-continued
M-85
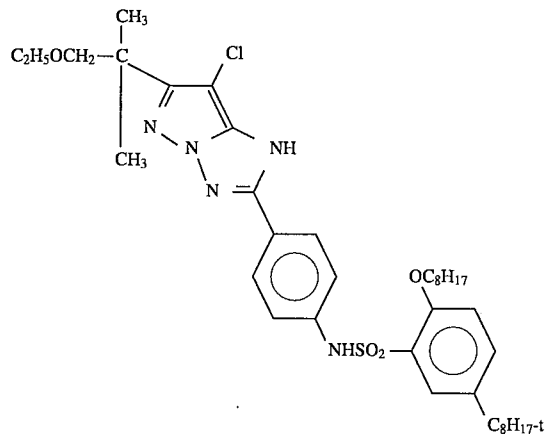
M-86
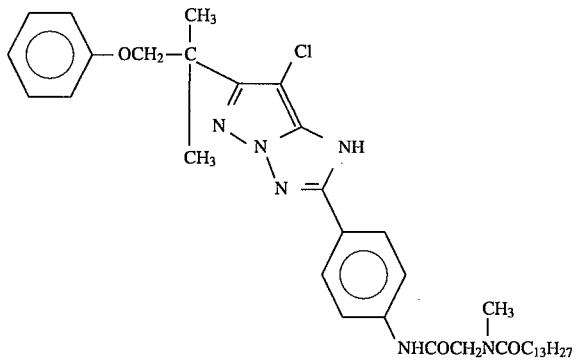

-continued
M-87
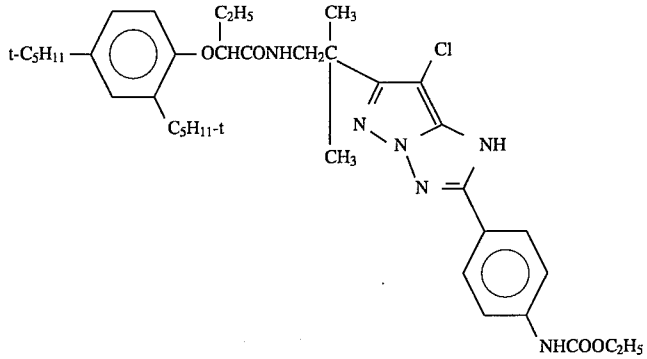
M-88
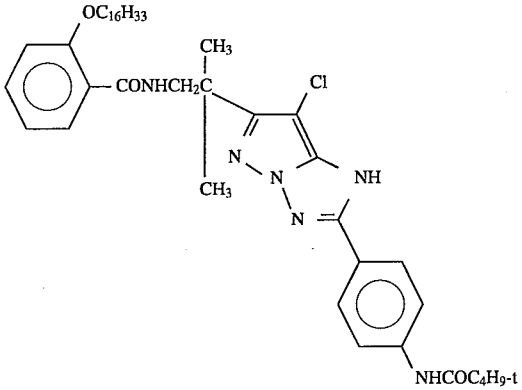

-continued
M-89
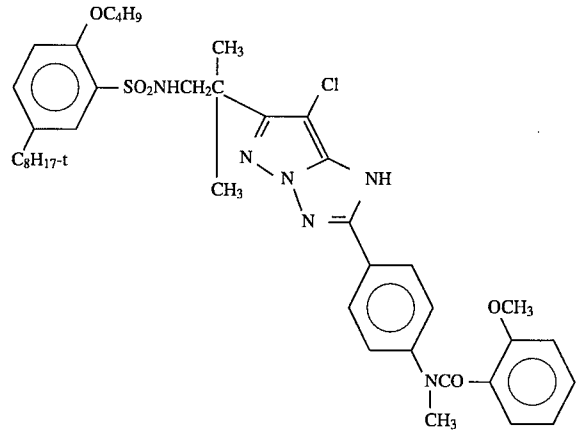
M-90
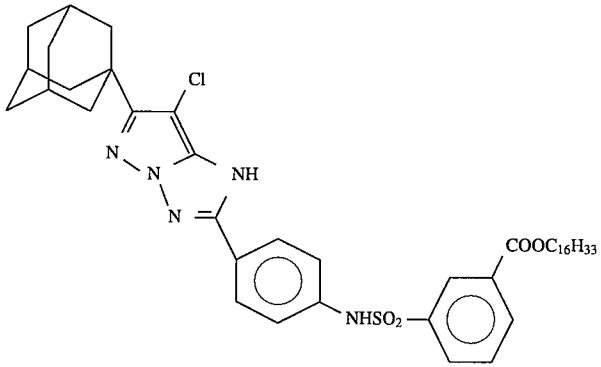

-continued
| | |
|---|---|
| M-91 | 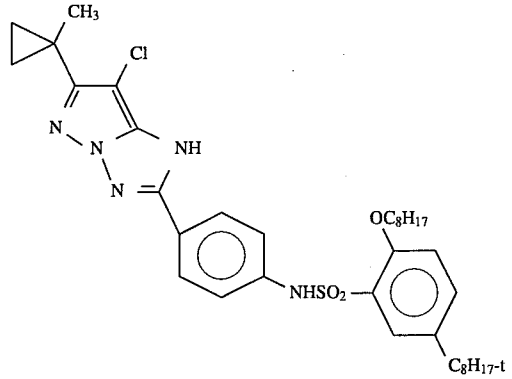 |

Specific examples of pyrazolotriazole couplers of formula (I) for use in the present invention and methods for producing them are described in, for example, JP-A 59-162548, 60-43659, 59-171956, 60-33552, 60-172982, 61-292143, 63-231341, 63-291058, U.S. Pat. Nos. 3,061,432, 4,728,598, EP 0 571 959 A2, etc.

The coupler may be incorporated into the photographic material of the present invention generally in an amount of from $1\times10^{-3}$ mol to 1 mol, preferably from $1\times10^{-2}$ mol to $8\times10^{-1}$ mol, per mol of the silver halide therein.

Two or more of the couplers may be incorporated into the photographic material. If desired, they may be used together with other couplers such as pyrazolone couplers different from them in their skeletons.

Next, compounds of formula (II) for use in the present invention will be explained in detail hereunder.

In formula (II), A, B and C each independently represent a substituted or unsubstituted alkyl, or substituted or unsubstituted alkoxy group each preferably having 1 to 20 carbon atoms, a substituted or unsubstituted aryl or substituted or unsubstituted aryloxy each preferably having 6 to 20 carbon atoms, or a substituted or unsubstituted heterocyclic group (e.g., pyridyl). As examples of the substituents for the substituted groups, mentioned are a hydroxyl group, a halogen atom (e.g., fluorine, chlorine, bromine), an alkyl group having from 1 to 12 carbon atoms (e.g., methyl, ethyl, butyl, trifluoromethyl, hydroxyoctyl, epoxymethyl), an alkoxy group having from 1 to 18 carbon atoms (e.g., methoxy, ethoxy, butoxy, cyclohexyloxy, benzyloxy), an aryloxy group having from 6 to 18 carbon atoms (e.g., phenoxy, m-methylphenoxy), an alkoxycarbonyl group (e.g., ethoxycarbonyl, 2-methoxyethoxycarbonyl), an aryloxycarbonyl group (e.g., phenoxycarbonyl, p-methylphenoxycarbonyl), an alkylthio group having from 1 to 18 carbon atoms (e.g., methylthio, butylthio), a carbamoyl group (e.g., methylcarbamoyl, butylcarbamoyl), etc.

As the other groups of A, B and C than the group of the above-mentioned formula (III), preferred are substituted or unsubstituted aryl and alkoxy groups.

$R_1'$ and $R_2'$ in formula (III) each independently represent a hydrogen atom, a halogen atom (e.g., fluorine, chlorine, bromine), a substituted or unsubstituted alkyl group having from 1 to 18 carbon atoms (e.g., methyl, trifluoromethyl, cyclohexyl, glycidyl), substituted or unsubstituted aryl group having from 6 to 18 carbon atoms (e.g., phenyl, tolyl), a substituted or unsubstituted alkoxy group having from 1 to 20 carbon atoms (e.g., methoxy, butoxy, 2-butoxyethoxy, 3-butoxy-2-hydroxypropyloxy), or a substituted or unsubstituted aryloxy group having from 6 to 18 carbon atoms (e.g., phenoxy, p-methylphenoxy).

One of $R_1'$ and $R_2'$ is preferably a substituted or unsubstituted alkoxy group having from 1 to 20 carbon atoms, and it is positioned at the para-position relative to the carbon atom bonding to the triazine ring.

Compounds of formula (II) for use in the present invention may be produced in accordance with the methods described in JP-A 46-3335 and European Patent 520938A1.

The compound of formula (II) is incorporated into the photographic material of the present invention in an amount of from 1 to 300% by weight, preferably from 20 to 200% by weight, relative to the magenta coupler (I) to be incorporated thereinto along with the compound.

Specific examples of compounds of formula (II) for use in the present invention are mentioned below, which, however, aloe not intended to restrict the scope of the present invention.

UV-1

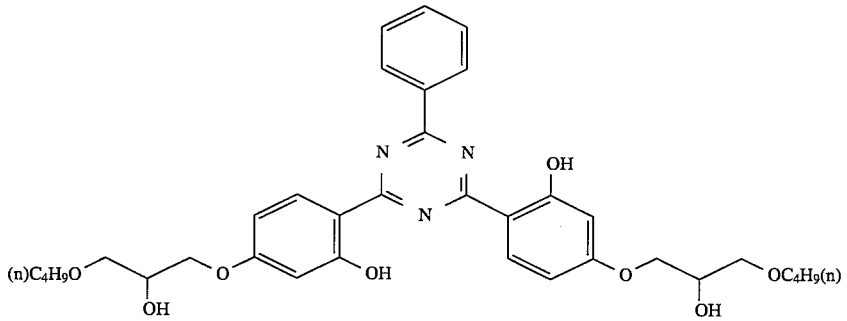

UV-2

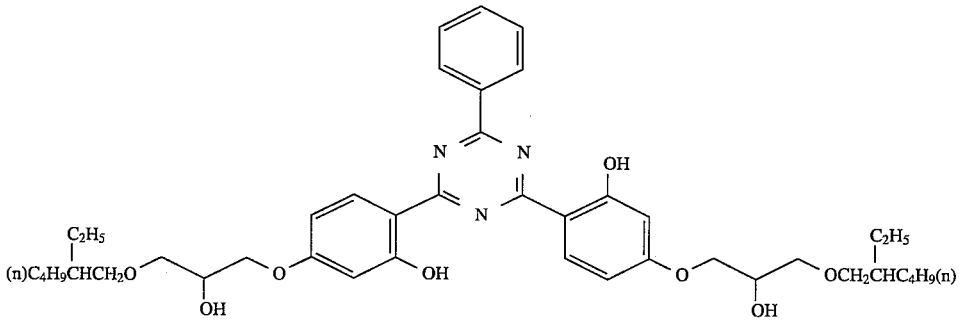

-continued
UV-3
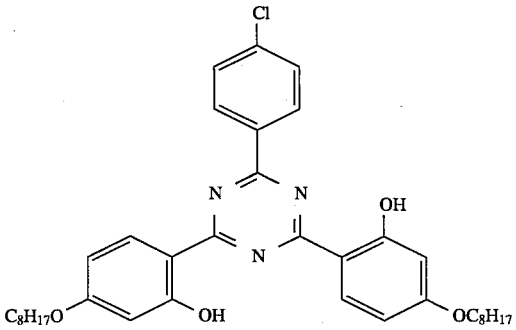
UV-4
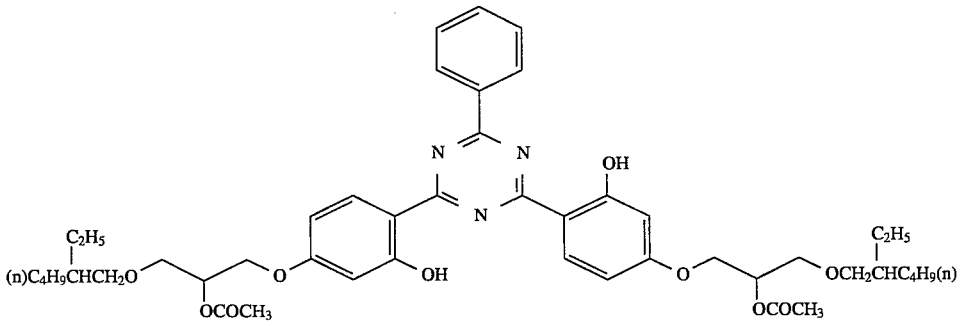
UV-5
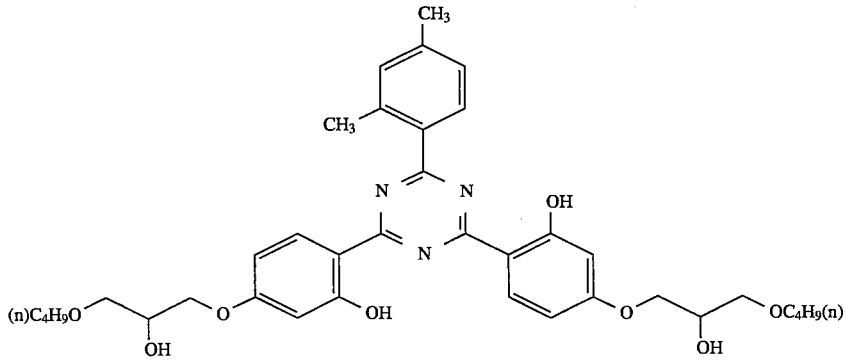
UV-6
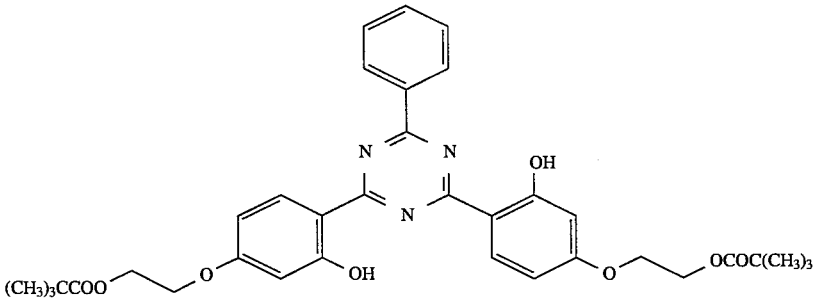
UV-7
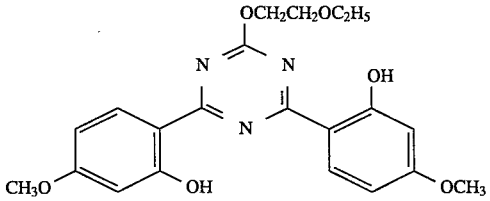

-continued
UV-8
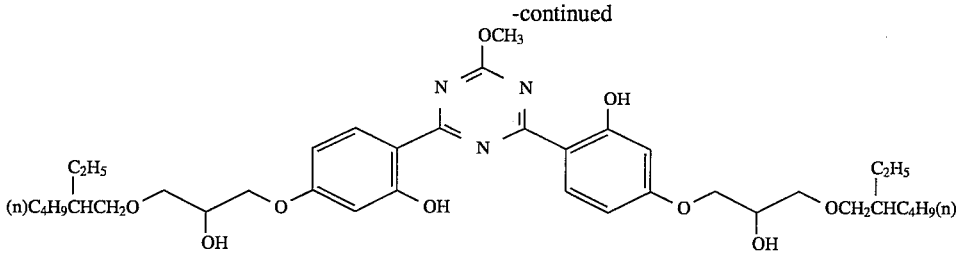
UV-9
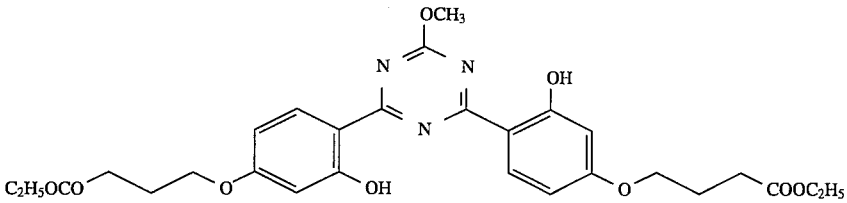
UV-10
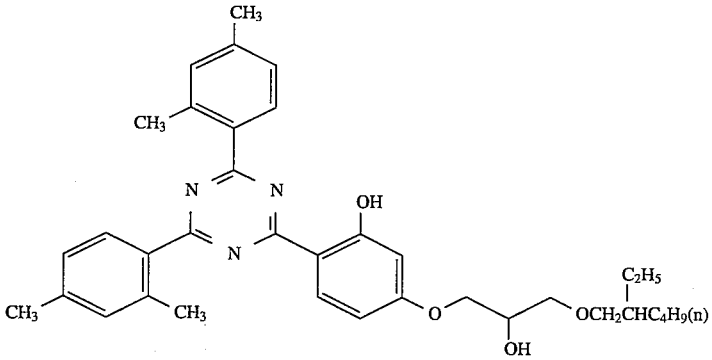
UV-11
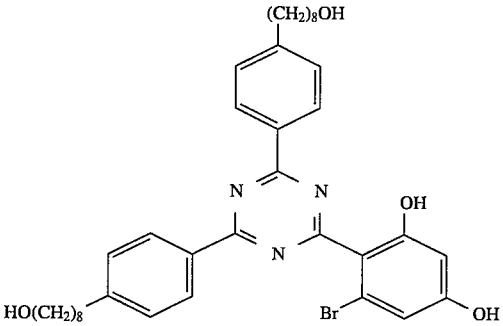
UV-12
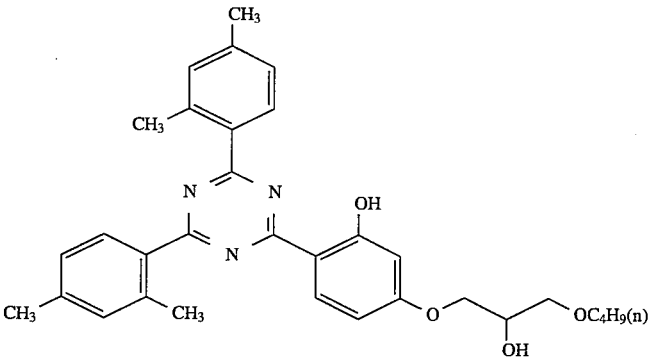

-continued
UV-13
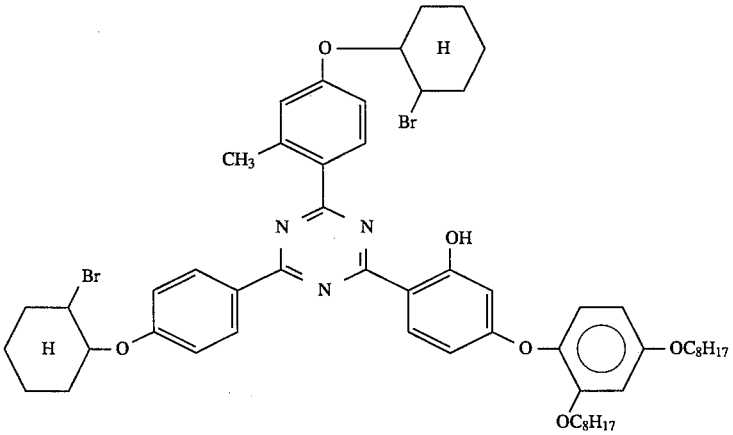
UV-14
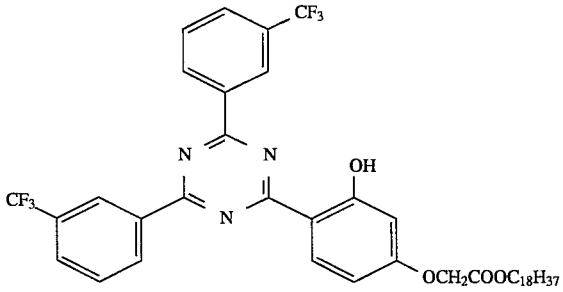
UV-15
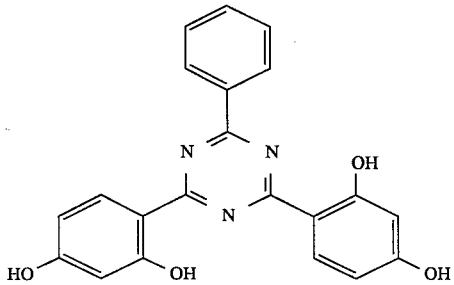
UV-16
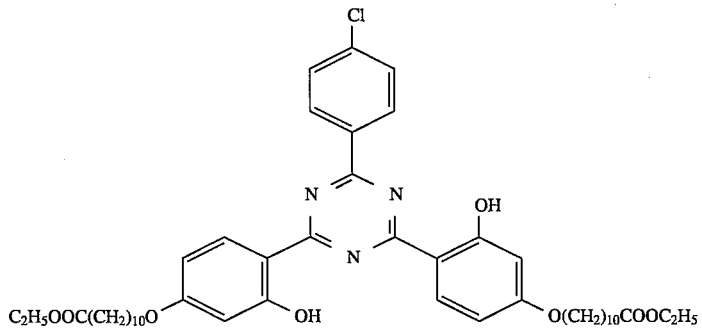
UV-17
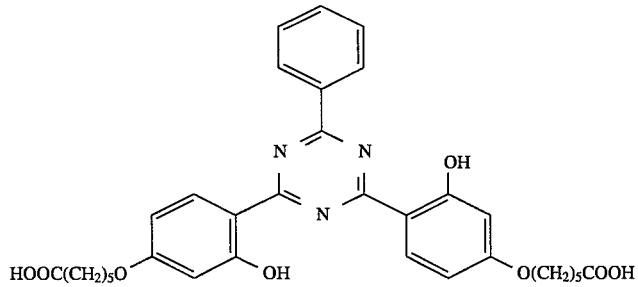

-continued
UV-18
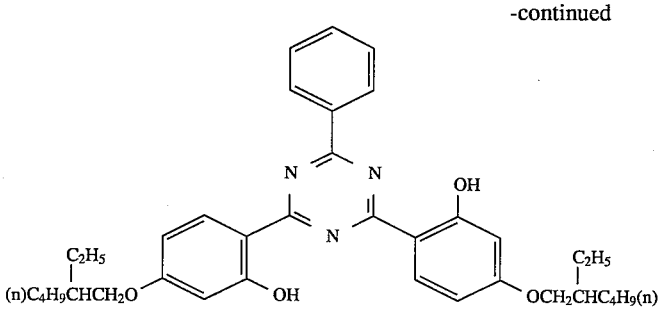
UV-19
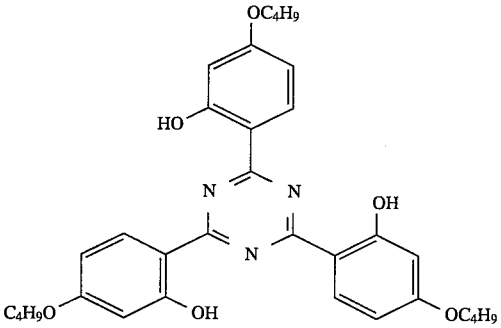
UV-20
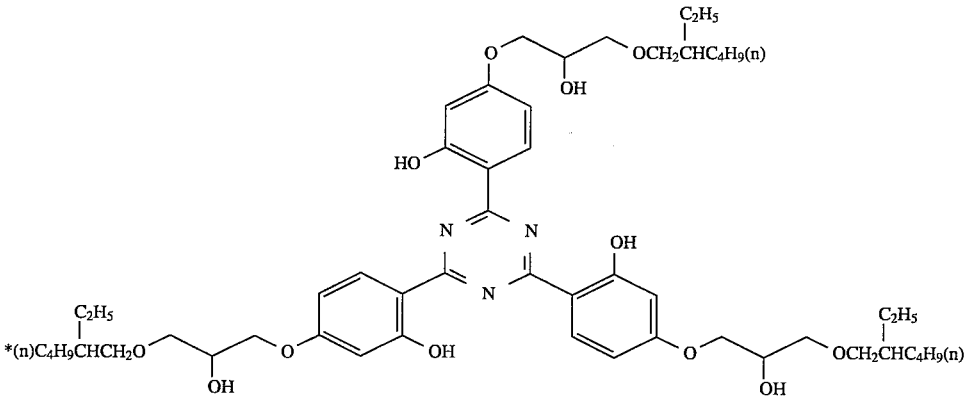
UV-21
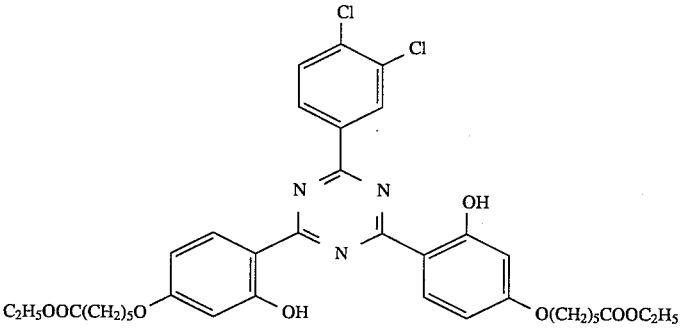

-continued
UV-22
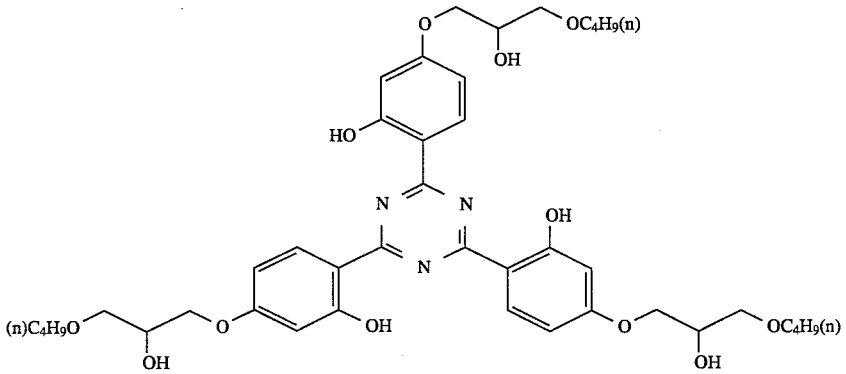
UV-23
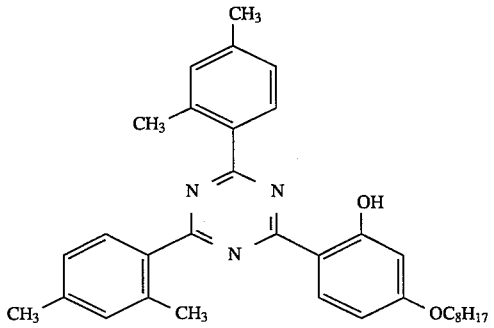
UV-24
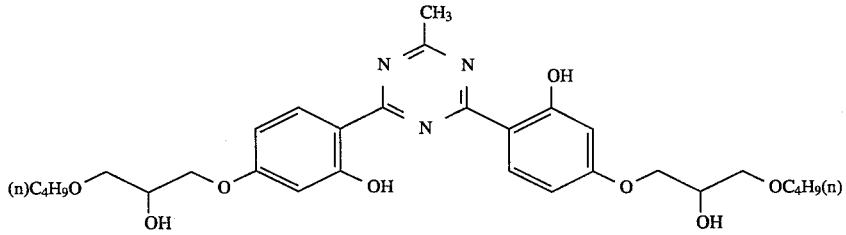
UV-25
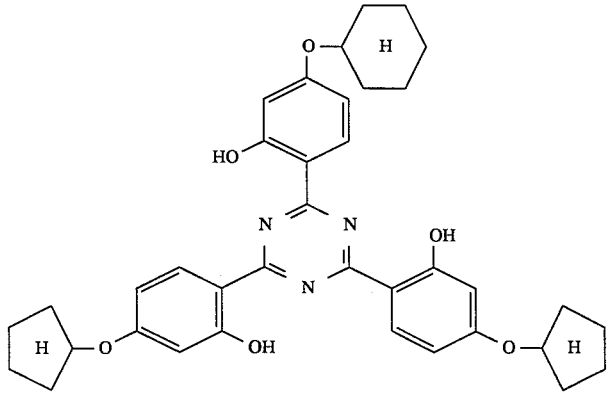
UV-26
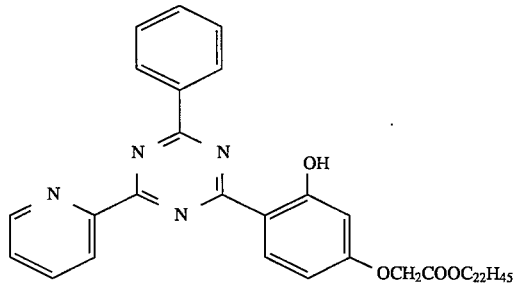

-continued
UV-27
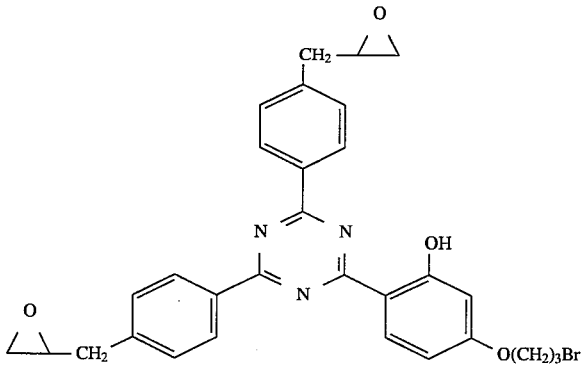
UV-28
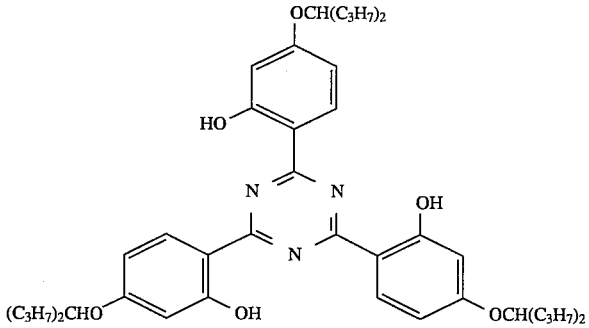
UV-29
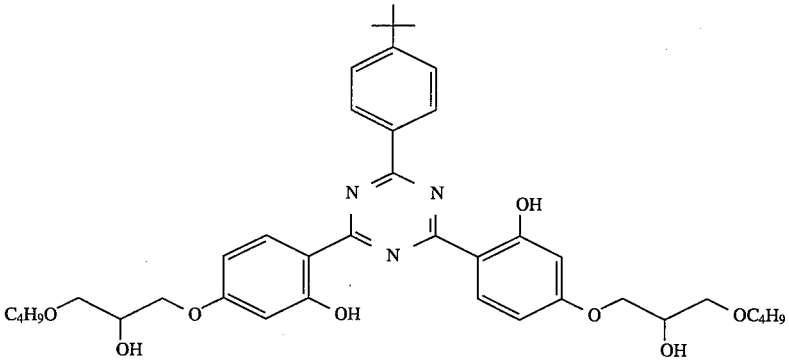
UV-30
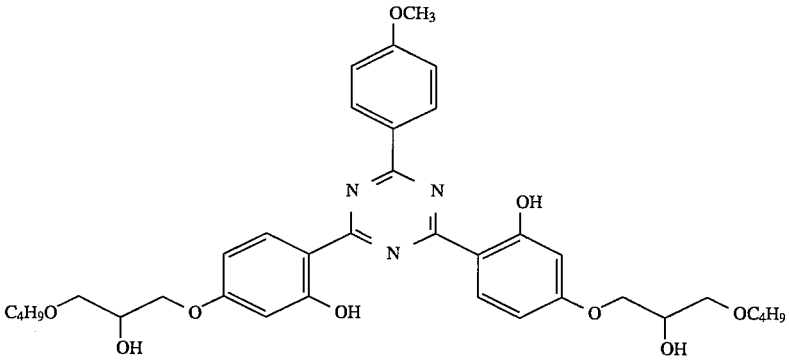

-continued

UV-31

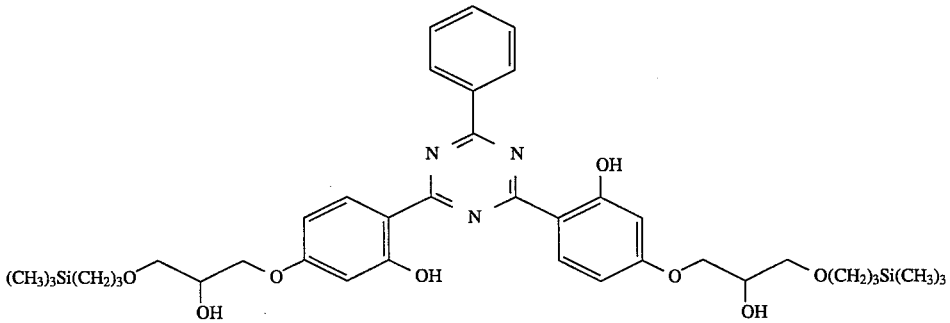

UV-32

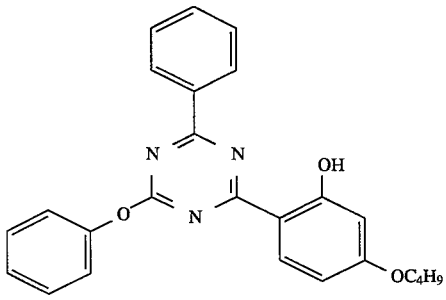

The photographic material of the present invention is required to have at least one layer containing the magenta coupler(s) of formula (I) on a support. The layer to which the magenta coupler(s) is/are added may be a hydrophilic colloid layer on the support. The constitution of an ordinary photographic material comprises at least one blue-sensitive silver halide emulsion layer, at least one green-sensitive silver halide emulsion layer and at least one red-sensitive silver halide emulsion layer formed on a support in this order. The photographic material of the present invention may have the same as or different from the constitution of such an ordinary photographic material. If desired, an infrared-sensitive silver halide emulsion layer may be employed in place of at least one of the above-mentioned light-sensitive emulsion layers. These light-sensitive emulsion layers each may contain a silver halide emulsion having a sensitivity to the wavelength range of the intended light and a color coupler capable of forming a dye complementary to the light, by which subtractive color reproduction is possible. However, the relationship between the light-sensitive emulsion layer and the color hue to be derived from the color coupler therein is not limited to only that satisfying the above-mentioned structure.

The magenta couplers of formula (I) can be incorporated into the photographic material of the present invention by various known dispersion methods. Preferably, they are dissolved in a high boiling point organic solvent (optionally along with a low boiling point organic solvent) and emulsified and dispersed in an aqueous gelatin solution and the resulting dispersion is added to a silver halide emulsion, in accordance with an oil-in-water dispersion method.

Examples of high boiling point solvents to be used in an oil-in-water dispersion method which may be employed in the present invention are described in U.S. Pat. No. 2,322,027. As one polymer dispersion method, known is a latex dispersion method which may also be employed in the present invention. The process of such a latex dispersion method, the effect of the same-and specific examples of latexes for impregnation to be used in the method are described in U.S. Pat. No. 4,199,363, German Patent OLS Nos. 2,541,274 and 2,541,230, JP-B 53-41091 and European Patent Application Laid-Open No. 029104. A dispersion method of using organic solvent-soluble polymers may also be employed in the present invention, which is described in PCT Laid-Open WO88/00723.

As examples of high boiling point organic solvents usable in the above-mentioned oil-in-water method, there are mentioned phthalates (e.g., dibutyl phthalate, dioctyl phthalate, dicyclohexyl phthalate, di-2-ethylhexyl phthalate, decyl phthalate, bis(2,4-di-t-amylphenyl) isophthalate, bis(1,1-diehtylpropyl) phthalate), phosphates or phosphonates (e.g., diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, di-2-ethylhexylphenyl phosphonate), benzoates (e.g., 2-ethylhexyl benzoate, 2,4-dichlorobenzoate, dodecyl benzoate, 2-ethylhexyl-p-hydroxybenzoate), amides (e.g., N,N-diethyldodecanamide, N,N-diethyllaurylamide), alcohols or phenols (e.g., isostearyl alcohol, 2,4-di-tert-amylphenol), aliphatic esters (e.g., dibutoxyethyl succinate, di-2-ethylhexyl succinate, 2-hexyldecyl tetradecanoate, tributyl citrate, diethyl azelate, isostearyl lactate, trioctyl citrate), aniline derivatives (e.g., N,N-dibutyl-2-butoxy-5-tert-octylaniline), chlorinated paraffins (e.g., paraffins having chlorine content of from 10% to 80%), trimesates (e.g., tributyl trimesate), dodecylbenzene, diisopropylnaphthalene, phenols (e.g., 2,4-di-tert-amylphenol, 4-dodecyloxyphenol, 4-dodecyloxycarbonylphenol, 4-(4dodecyloxyphenylsulfonyl)phenol), carboxylic acids (e.g., 2- (2,4-di-tert-amylphenoxybutyric acid, 2-ethoxyoctanedecanoic acid), and alkylphosphoric acids (e.g., di-2-(ethylhexyl)phosphoric acid, diphenylphosphoric acid). As auxiliary solvents usable along with the high boiling point organic solvents, there are mentioned, for example, organic solvents having a boiling point of approximately from 30° C. to 160° C., such as ethyl acetate, butyl acetate, ethyl propionate, methyl ethyl ketone, cyclohexanone, 2-ethoxyethyl acetate, and dimethylformamide.

The weight ratio of the high boiling point organic solvent to be used may be from 0 to 10.0, preferably from 0 to 4.0, to the coupler.

To add the compound(s) of formula (II) to the photographic material of the present invention, it is preferred that the compound(s) is/are dissolved in a high boiling point organic solvent along with the coupler(s) of formula (I), especially the coupler of formula (If), and co-emulsified to give an emulsified dispersion and the resulting dispersion is added to the photographic constitutive layer of the material. The photographic constitutive layer thus containing the compounds of formulae (I) and (II) is preferably a light-sensitive silver halide emulsion layer. The light-sensitive emulsion layer is preferably a green-sensitive layer but may be an infrared-sensitive layer, red-sensitive layer or blue-sensitive layer. The light-sensitive emulsion layer comprises a silver chlorobromide emulsion which contains 90 mol % or more of silver chloride or a silver chloride emulsion and contains substantially no silver iodide.

As cyan couplers, preferably used in the present invention are diphenylimidazole cyan couplers such as those described in JP-A 2-33144 as well as 3-hydroxypyridine cyan couplers such as those described in European Patent EP0333185A2 (especially preferably, 2-equivalent couplers to be prepared by introducing a chlorine split-off group into a 4-equivalent coupler of illustrated Coupler (42), as well as illustrated Couplers (6) and (9)), cyclic active methylene cyan couplers such as those described in JP-A 64-32260 (especially preferably, illustrated Couplers 3, 8 and 34), pyrrolopyrazole cyan couplers such as those described in European Patent EP0456226A1, pyrroloimidazole cyan couplers such as those described in European Patent EP0484909, and pyrrolotriazole cyan couplers such as those described in European Patents EP 0488248 and EP0491197A1. Of these, especially preferred are pyrrolotriazole cyan couplers.

As yellow couplers, preferably used in the present invention are the compounds mentioned below and, in addition to these, acylacetamide yellow couplers where the acyl group has a 3-membered to 5-membered ring structure such as those described in European Patent EP0447969A1, malondianilide yellow couplers having a cyclic structure such as those described in European Patent EP0482552A1, and acylacetamide yellow couplers having a dioxane structure such as those described in U.S. Pat. No. 5,118,599. Of these, especially preferred are acylacetamide yellow couplers where the acyl group is an 1-alkylcyclopropane-1-carbonyl group, and malondianilide yellow couplers where one of the anilido moieties constitutes an indoline ring. These couplers may be used singly or in combination of two or more of them.

To process the photographic materials of the present invention, the methods mentioned below may be employed. In addition to these, preferably usable are the processing materials and the methods described in JP-A 2-207250, from page 26, right bottom column, line 1 to page 34, right top column, line 9, and in JP-A 4-97355, from page 5, left top column, line 17 to page 18, right bottom column, line 20.

For silver halide emulsions and other elements (additives, etc.) of constituting the photographic material of the present invention as well as the constitution of photographic layers (arrangement of layers, etc.) of the materials, and processing methods and processing additives to be used for processing the materials, for example, disclosures of the following references, especially the following European Patent EP0, 355,660A2, may be referred to.

| Photographic Elements | JP-A 62-215272 | JP-A 2-33144 | EP 0,355,660A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, line's 20 to 22 |
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left upper column, line 7 to page 125, right upper column, line 1 | — | — |
| Ultraviolet Absorbents | From page 125, right upper column, line 2 to page 127, | From page 37, right lower column, line 14 to page 38, | Page 65, lines 22 to 31 |

-continued

| Photographic Elements | JP-A 62-215272 | JP-A 2-33144 | EP 0,355,660A2 |
|---|---|---|---|
| | left lower column, last line | left upper column, line 11 | |
| Anti-fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right lower column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to pale 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |
| Fluorine-containing Compounds (as antistatic agents, coating aids, lubricants, and anti-blocking agents) | From page 210, left lower column, line 1 to page 222, left lower column, line 5 | From page 25, left upper column, line 1 to page 27, right lower column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |
| Photographic Processing Methods (Processing steps and additives) | From page 3, right upper column, line 7 to page 10, right upper column, line 5 | From page 39, left upper column, line 4 to page 42 left upper column, last line | From page 67, line 14 to page 69, line 28 |

Notes:

The cited specification of JP-A 62-215272 is one as amended by the letter of amendment filed on Mar. 16, 1987.

As yellow couplers, preferred are so-called short-waved yellow couplers such as those described in JP-A 63-231451, 63-123047, 63-241547, 1-173499, 1-213648 and 1-250944.

The silver halide for use in the present invention includes, for example, silver chloride, silver bromide, silver chlorobromide, silver iodochloride, silver iodochlorobromide and silver iodobromide. Especially for the purpose of rapid processing of the photographic material of the present invention, preferred is a silver chlorobromide emulsion substantially not containing silver iodide and having a silver chloride content of 90 mol % or more, more preferably 95 mol % or more, especially preferably 98 mol % or more or a pure silver chloride emulsion.

The photographic material of the present invention preferably contains, for the purpose of improving the sharpness of the image to be formed, dye(s) capable of being decolored by photographic processing such as those described in European Patent 0,337,490A2, pages 27 to 76, especially oxonole dyes, in the hydrophilic colloid layers in such a way that the optical reflection density of the material at 680 nm is 0.70 or more, or contains titanium oxide as surface-treated with a dihydric to tetrahydric alcohol (e.g., trimethylolethane) in an amount of 12% by weight or more, more preferably 14% by weight or more, in the water-proofing resin layer of the support.

It is also preferred that the photographic material of the present invention contains a color image preservability improving compound such as those described in European Patent 0,277,589A2 along with couplers. In particular, combination of such a compound and pyrazoloazole magenta couplers is preferred.

Specifically, preferred is incorporation of (F) a compound which may bond to an aromatic amine developing agent as remained in the color-developed photographic material to form a chemically-inactive and substantially-colorless compound and/or (G) a compound which may bond to an oxidation product of an aromatic amine developing agent as remained in the color-developed photographic material to form a chemically-inactive and substantially-colorless compound, singly or in combination of them. This is because the incorporation is effective in preventing generation of stains or other harmful side effects in the processed photographic material due to formation of coloring dyes by reaction of the remaining color developing agent or the oxidation product thereof with couplers during storage of the processed photographic material.

The photographic material of the present invention preferably contains a microbicide such as those described in JP-A 63-271247, for the purpose of preventing propagation of various fungi and bacteria to deteriorate the image to be formed, in the hydrophilic colloid layers.

The support of the photographic material of the present invention may be a white polyester support or a support having a white pigment-containing layer on its surface to be coated with silver halide emulsion layers, for display use. In addition, for the purpose of improving the sharpness of the image to be formed, the support preferably has an antihalation layer on its surface to be coated with silver halide emulsion layer or on its back surface opposite to the said surface. In particular, the transmission density of the support is desired to fall within the range of from 0.35 to 0.8 in order that the display may be viewed by either a reflected light or a transmitted light.

The silver halide photographic material of the present invention may be exposed to visible rays or infrared rays. For exposure of the material, either low-intensity exposure or high-intensity short-time exposure may be employed. Especially for the latter case, preferred is a laser-scanning exposure system having an exposure time of shorter than $10^{-4}$ second per pixcel.

For exposure of the material, a band-pass filter such as that described in U.S. Pat. No. 4,880,726 is preferably employed. Using it, light mixing may be prevented during exposure and the color reproducibility of the exposed material is noticeably improved.

Color developers are used to process the color photographic materials of the present invention. These preferably contain an organic preservative in place of hydroxylamine and sulfite ions.

The organic preservative includes organic compounds which are added to processing solutions for processing color photographic materials so as to decrease the deterioration rate of the aromatic primary amine color developing agent in the processing solution. That is, the compounds have a function of preventing aerial oxidation of color developing agents. Especially effective organic preservatives are hydroxylamine derivatives (excluding hydroxylamine), hydroxamic acids, hydrazines, hydrazides, α-amino acids, phenols, α-hydroxyketones, α-aminoketones, saccharides, monoamines, diamines, polyamines, quaternary ammonium salts, nitroxy radicals, alcohols, oximes, diamide compounds, condensed cyclic amines, etc. These are illustrated in JP-B 48-30496, JP-A 52-143020, 63-4235, 63-30845, 63-21647, 63-44655, 63-53551, 63-43140, 63-56654, 63-58346, 63-43138, 63-146041, 63-44657, 63-44656, U.S. Pat. Nos. 3,615,503, 2,494,903, JP-A 1-97953, 1-186939, 1-186940, 1-187557, 2-306244, European Patent EP0530921A1, etc. As other preservatives, if desired, also usable are various metals such as those described in JP-A 57-44148 and 57-53749, salicylic acids such as those described in JP-A 59-180588, amines described in JP-A 63-239447, 63-128340, 1-186939 and 1-187557, alkanolamines such as those described in JP-A 54-3532, polyethyleneimines such as those described in JP-A 56-94349, and aromatic polyhydroxy compounds such as those described in U.S. Pat. No. 3,746,544. Especially preferred are alkanolamines such as triethanolamine, dialkylhydroxylamines such as N,N-diehtylhydroxylamine and N,N-di(sulfoethyl)hydroxylamine, α-amino acid derivatives such as glycine, alanine, leucine, serine, threonine, valine and isoleucine, and aromatic polyhydroxyl compounds such as sodium catechol-3,5-disulfonate.

To use the combination of dialkylhydroxylamines and alkanolamines or the combination of dialkylhydroxylamines such as those described in European Patent EP0530921A1 and α-amino acids such as glycine along with alkanolamines is preferred, so as to improve the stability of color developers and, in addition, to improve the stability of them during continuous processing.

The amount of the organic preservative to be added to the color developer may be such that it displays a function of preventing the deterioration of the color developing agent in the color developer. Preferably, it is from 0.01 to 1.0 mol/liter, more preferably from 0.03 to 0.30 mol/liter.

The present invention is explained in more detail by means of the following examples, which, however, are not intended to restrict the scope of the present invention.

EXAMPLE 1

Photographic material samples each having the layer constitution mentioned below were prepared. The number referred to hereunder means the amount coated (g/m$^2$). The amount of the silver halide emulsion coated is represented by the amount of silver therein.

| | |
|---|---|
| Support: | |
| Polyethylene-laminated Paper (containing white pigment ($TiO_2$) and bluish dye (ultramarine) in polyethylene below the first layer) | |
| First Layer (Green-sensitive Emulsion Layer): | |
| Silver Chlorobromide Emulsion (1/3 (as silver molar ratio) mixture comprising a large-size emulsion of cubic grains with a mean grain size of 0.55 μm and a small-size emulsion of cubic grains with a mean grain size of 0.39 μm; the two emulsions each having a fluctuation coefficient of grain size distribution of 0.10 and 0.08, respectively, and each having 0.8 mol % of AgBr locally on the surfaces of the grains) | 0.13 |
| Gelatin | 2.50 |
| Magenta Coupler (Table 1) | 0.30 |
| Color Image Stabilizer-1 | 0.05 |
| Color Image Stabilizer-2 | 0.02 |
| Solvent-1 | 0.90 |
| Compound of formula (II) (Table 1) | 0.30 |
| Second Layer (Protective Layer): | |
| Gelatin | 2.00 |
| Solvent-1 | 0.30 |
| Compound of formula (II) (Table 1) | 0.30 |

The "size" of silver halide grains as referred to hereinafter means the length of the edge of the cubic grains.

Varying the compounds to be in the first and second layers in the manner as indicated in Table 1 below, Sample Nos. 101 to 118 were prepared.

Color Image Stabilizer-1:

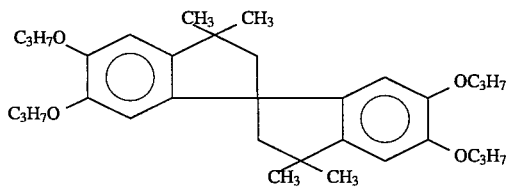

Color Image Stabilizer-2:

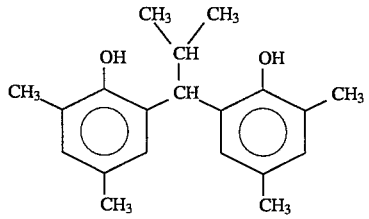

Solvent-1:

2:1 (by weight) mixture of:
$(n)C_4H_9OOC-(CH_2)_8-COOC_4H_9(n)$ and
$O=P-(OC_6H_{13}(n))_3$ 18 samples thus prepared were wedgewise exposed to green light, using a sensitometer (FWH Model, made by Fuji Photo Film Co.), and then processed according to the process mentioned below.

A standard sample was processed continuously with a paper processor using the processing solutions mentioned below, in accordance with the process also mentioned running below, whereby a processing system with running equivalence was prepared.

Processing Steps:

| Step | Temp. | Time | Replenisher (ml) (*) | Tank Capacity (liter) |
|---|---|---|---|---|
| Color Development | 35° C. | 45 sec | 161 | 17 |
| Bleach-Fixation | 30 to 35° C. | 45 sec | 215 | 17 |
| Rinsing | 30 | 90 sec | 350 | 10 |
| Drying | 70 to 80° C. | 60 sec | | |

(*) This is an amount of the replenisher per $m^2$ of the photographic paper sample being processed.

The processing solutions used above are mentioned below.

| | Tank Solution | Replenisher |
|---|---|---|
| Color Developer: | | |
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 1.4 g | — |
| Potassium Carbonate | 25 g | 25 g |
| N-ethyl-N-(β-methanesulfonamido-ethyl)-3-mehtyl-4-aminoaniline Sulfate | 5.0 g | 7.0 g |
| N,N-bis(carboxymethyl)hydrazine | 4.0 g | 5.0 g |
| Brightening Agent (WHITEX 4B, product by Sumitomo Chemical Co.) | 1.0 g | 2.0 g |
| Water to make | 1000 ml | 1000 ml |
| pH (25° C.) | 10.05 | 10.45 |
| Bleach-fixing Solution: Both the tank solution and the replenisher were the same. | | |
| Water | 400 ml | |
| Ammonium Thiosulfate (70%) | 100 ml | |
| Sodium Sulfite | 17 g | |
| Ammonium Ethylenediaminetetraacetato/iron(III) | 55 g | |
| Disodium Ethylenediaminetetraacetate | 5 g | |
| Ammonium Bromide | 40 g | |
| Water to make | 1000 ml | |
| pH (25° C.) | 6.0 | |
| Rinsing Solution: | | |
| Both the tank solution and the replenisher were same. An ion-exchanged water (having calcium content and magnesium content of each being 3 ppm or less) was used. | | |

The exposed samples were processed, using the above-mentioned processing solutions. The thus-processed samples were subjected to a test for determining Y-stains in the non-colored area, according to the process mentioned below. The test results obtained are shown in Table 1 below.

Test for Y-stains:

The samples were put on an underglass outdoor exposing stand and exposed to sun light for 2 months. The yellow density in the non-colored area of each sample, before and after the exposure to sun light, was measured to be DB (before exposure) and DB' (after exposure). Y-stains are represented by the following equation:

$$Y\text{-}stains = DB' - DB.$$

The test results obtained are shown in Table 1.

TABLE 1

| Sample No. | 2nd Layer Compound of Formula (II) | 1st Layer Coupler of Formula (I) | 1st Layer Compound of Formula (II) | Y-Stains | Remarks |
|---|---|---|---|---|---|
| 101 | — | M-38 | — | 0.13 | comparative sample |
| 102 | UV-5 | M-38 | — | 0.10 | comparative sample |
| 103 | — | M-38 | UV-5 | 0.04 | sample of the invention |
| 104 | UV-9 | M-39 | — | 0.09 | comparative sample |
| 105 | — | M-39 | UV-9 | 0.03 | sample of the invention |
| 106 | UV-10 | M-40 | — | 0.12 | comparative sample |
| 107 | — | M-40 | UV-10 | 0.04 | sample of the invention |
| 108 | UV-12 | M-45 | — | 0.12 | comparative sample |
| 109 | — | M-45 | UV-12 | 0.03 | sample of the invention |
| 110 | UV-20 | M-60 | — | 0.10 | comparative sample |
| 111 | — | M-60 | UV-20 | 0.02 | sample of the invention |
| 112 | — | M-36 | — | 0.10 | comparative sample |
| 113 | UV-23 | M-36 | — | 0.08 | comparative sample |
| 114 | — | M-36 | UV-23 | 0.02 | sample of the invention |
| 115 | — | M-36 | UV-5 | 0.02 | sample of the invention |
| 116 | — | M-36 | UV-9 | 0.02 | sample of the invention |
| 117 | — | M-36 | UV-10 | 0.02 | sample of the invention |
| 118 | — | M-36 | UV-12 | 0.02 | sample of the invention |

From Table 1 above, it is understood that even though only the compound of formula (II) is incorporated into the second layer, the Y-stains in the processed samples were not reduced, but when it is incorporated into the same along with the coupler of formula (I), the Y-stains in the processed samples were remarkably reduced. From the results, it is understood that the reduction of the Y-stains is not caused by mere UV-cutting effect.

EXAMPLE 2

One surface of a paper support, both surfaces of which had been laminated with polyethylene, was subjected to corona discharging treatment, and a subbing gelatin layer containing sodium dodecylbenzenesulfonate was provided on the surface and plural photographic layers mentioned below were then coated over the subbing layer to prepare a multi-layer color photographic paper (sample No. 201). Coating compositions for the photographic layers were prepared as mentioned below.

Preparation of Coating composition for First Layer:

153.0 g of an yellow coupler (ExY), 15.0 g of a color image stabilizer (Cpd-1), 7.5 g of a color image stabilizer (Cpd-2) and 16.0 g of a color image stabilizer (Cpd-3) were dissolved in 25 g of a solvent (Solv-1), 25 g of a solvent (Solv-2) and 180 cc of ethyl acetate, and the resulting solution was dispersed by emulsification in 1000 g of aqueous 10% gelatin solution containing 60 cc of 10% sodium dodecylbenzenesulfonate and 10 g of citric acid to prepare an emulsified dispersion A. On the other hand, a silver chlorobromide emulsion A was prepared, which was a mixture (3/7 as silver molar ratio) comprising a large-size emulsion A of cubic grains having a mean grain size of 0.88 μm and a small-size emulsion A of cubic grains having a mean grain size of 0.70 μm. The two emulsions had a fluctuation coefficient of grain size distribution of 0.08 and 0.10, respectively. They each had 0.3 mol % of silver bromide locally on a part of the surfaces of the grains each consisting essentially of silver chloride. Blue-sensitizing dyes A and B mentioned below were added to the mixture emulsion in an amount of $2.0\times10^{-4}$ mol per mol of silver to the large-size emulsion A and $2.5\times10^{-4}$ mol per mol of silver to the small-size emulsion A. Then, the mixture emulsion was chemical-sensitized with a sulfur sensitizer and a gold sensitizer. The previously prepared emulsified dispersion A and the silver chlorobromide mixture emulsion A were blended to obtain a coating composition for the first layer, which comprised the components mentioned below. The amount of the emulsion coated indicates the amount of silver therein.

Other coating compositions for the second layer to the seventh were prepared in the same manner as above. 1-Hydroxy-3,5-dichloro-s-triazine sodium salt was used as the gelatin hardening agent for each layer.

Each layer contained 25.0 mg/m$^2$ of Cpd-14 and 50.0 mg/m$^2$ of Cpd-15.

The following color sensitizing dyes were added to the silver chlorobromide emulsions for the respective light-sensitive layers.

Blue-sensitive Emulsion Layer:

Sensitizing Dye A:

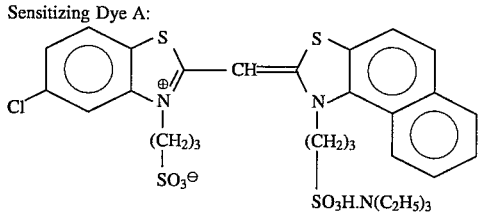

and

-continued

Sensitizing Dye B:

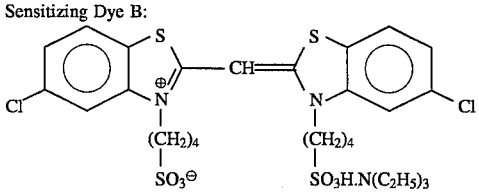

(The both were added each in an amount of 2.0 x $10^{-4}$ mol per mol of silver halide to the large-size emulsion and 2.5 x $10^{-4}$ mol per mol of silver halide to the small-size emulsion.)

Green-sensitive Emulsion Layer:

Sensitizing Dye C:

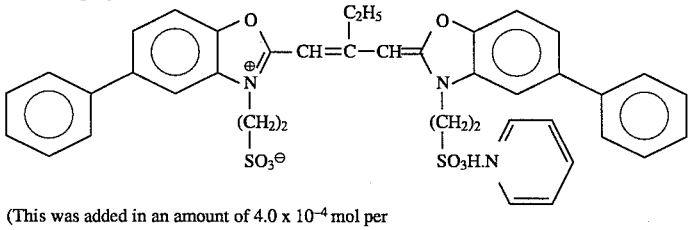

(This was added in an amount of 4.0 x $10^{-4}$ mol per mol of silver halide to the large-size emulsion and 5.6 x $10^{-4}$ mol per mol of silver halide to the small-size emulsion.)

and

Sensitizing Dye D:

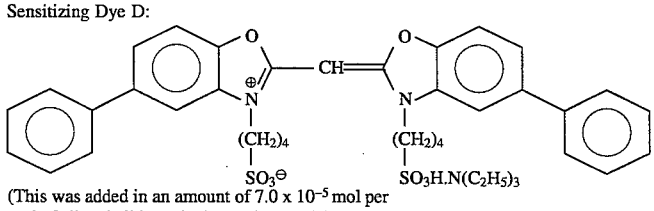

(This was added in an amount of 7.0 x $10^{-5}$ mol per mol of silver halide to the large-size emulsion and 1.0 x $10^{-4}$ mol per mol of silver halide to the small-size emulsion.)

Red-sensitive Emulsion Layer:

Sensitizing Dye E:

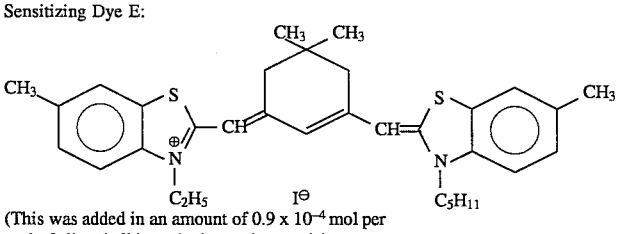

(This was added in an amount of 0.9 x $10^{-4}$ mol per mol of silver halide to the large-size emulsion and 1.1 x $10^{-4}$ mol per mol of silver halide to the small-size emulsion.)

To the red-sensitive emulsion layer was added the following compound in an amount of $2.6\times10^{-3}$ mol per mol of silver halide.

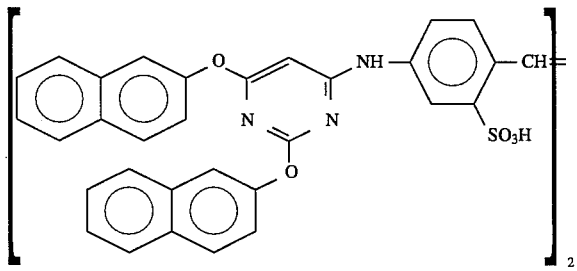

To each of the blue-sensitive emulsion layer, green-sensitive emulsion layer and red-sensitive emulsion layer was added 1-(5-methylureidophenyl)-5-mercaptotetrazole in an amount of $8.5\times10^{-5}$ mol, $7.7\times10^{-4}$ mol and $2.5\times10^{-4}$ mol, each per mol of silver halide, respectively. To each of the blue-sensitive emulsion layer and green-sensitive emulsion layer was added 4-hydroxy-6-methyl-1,3,3a,7-tetrazaindene in an amount of $1\times10^{-4}$ mol and $2\times10^{4}$ mol, each per mol of silver halide, respectively. The following dyes were added to each emulsion layer for anti-irradiation. (The amount as parenthesized indicate the amount of each dye coated.)

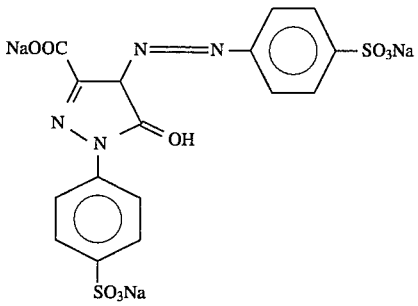

(10 mg/m²)

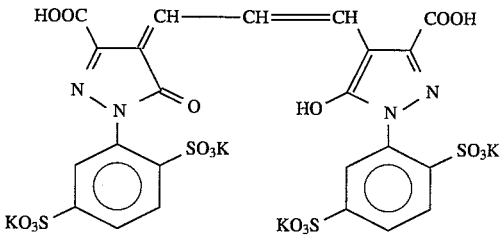

(10mg/m²)

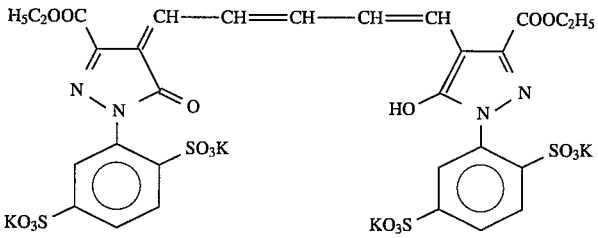

(40mg/m²)

and

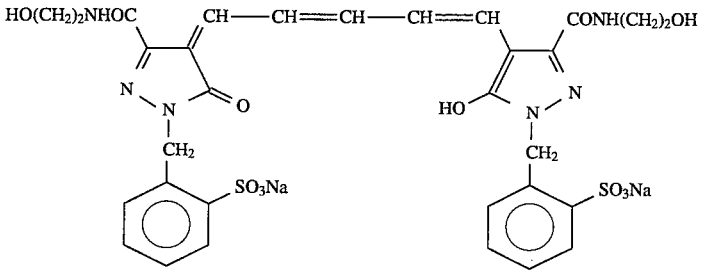

(20mg/m²)

To the third layer, added was the compound of formula (II) indicated in Table 2 below. In Sample No. 205 and Sample No. 212, the compound of formula (II) was added to the fifth layer but not to the third layer in order to clarify the effect of the present invention. (The effect of the present invention is not mere UV-cutting effect.)

Layer Constitution of Photographic Material Samples:

The composition of each layer of the photographic material sample is mentioned below. The number indicates the amount of the component coated (g/m²). The amount of the silver halide emulsion coated is represented by the amount of silver therein coated.

| | |
|---|---|
| Support: | |
| Polyethylene-laminated Paper (containing white pigment ($TiO_2$) and bluish dye (ultramarine) in polyethylene below the first layer) | |
| First Layer (Blue-sensitive Emulsion Layer): | |
| Above-mentioned Silver Chlorobromide Emulsion A | 0.27 |

-continued

| | |
|---|---|
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Solvent (Solv-1) | 0.13 |
| Solvent (Solv-2) | 0.13 |

| | |
|---|---|
| Second Layer (Color Mixing Preventing Layer): | |
| Gelatin | 1.10 |
| Color Mixing Preventing Agent (Cpd-4) | 0.14 |
| Solvent (Solv-2) | 0.30 |
| Solvent (Solv-1) | 0.04 |
| Solvent (Solv-7) | 0.04 |
| UV Absorbent (UV-3) | 0.15 |
| Third Layer (Green-sensitive Emulsion Layer): | |
| Silver Chlorobromide Emulsion (1/3 (as silver molar ratio) mixture comprising a large-size emulsion B of cubic grains with a mean grain size of 0.55 μm and a small-size emulsion B of cubic grains with a mean grain size of 0.39 μm; the two emulsions each having a fluctuation coefficient of grain size distribution of 0.10 and 0.08, respectively, and each having 0.8 mol % of AgBr locally on the surfaces of the grains consisting essentially of silver chloride) | 0.13 |
| Gelatin | 1.30 |
| Magenta Coupler (Table 2) | 0.14 |
| Color Image Stabilizer (Cpd-2) | 0.01 |
| Color Image Stabilizer (Cpd-5) | 0.01 |
| Color Image Stabilizer (Cpd-6) | 0.01 |
| Color Image Stabilizer (Cpd-7) | 0.01 |
| Color Image Stabilizer (Cpd-8) | 0.03 |
| Color Image Stabilizer (Cpd-12) | 0.17 |
| Solvent (Solv-4) | 0.16 |
| Solvent (Solv-5) | 0.32 |
| Fourth Layer (Color Mixing Preventing Layer): | |
| Gelatin | 0.78 |
| Color Mixing Preventing Agent (Cpd-4) | 0.10 |
| Solvent (Solv-2) | 0.13 |
| Solvent (Solv-1) | 0.03 |
| Solvent (Solv-7) | 0.03 |
| UV Absorbent (UV-3) | 0.11 |

| | |
|---|---|
| Fifth Layer (Red-sensitive Layer): | |
| Silver Chlorobromide Emulsion (1/4 (as silver molar ratio) mixture comprising a large-size emulsion C of cubic grains with a mean grain size of 0.50 μm and a small-size emulsion C of cubic grains with a mean grain size of 0.41 μm; the two emulsions each having a fluctuation coefficient of grain size distribution of 0.09 and 0.11, respectively, and each having 0.8 mol % of AgBr locally on the surfaces of the grains consisting essentially of silver chloride) | 0.20 |
| Gelatin | 0.85 |
| Cyan Coupler (ExC) | 0.33 |
| UV Absorbent (UV-2) | 0.18 |
| Color Image Stabilizer (Cpd-1) | 0.33 |
| Color Image Stabilizer (Cpd-6) | 0.01 |
| Color Image Stabilizer (Cpd-8) | 0.01 |
| Color Image Stabilizer (Cpd-9) | 0.01 |
| Color Image Stabilizer (Cpd-10) | 0.01 |
| Color Image Stabilizer (Cpd-11) | 0.01 |
| Solvent (Solv-1) | 0.01 |
| Solvent (Solv-6) | 0.22 |
| Sixth Layer (UV Absorbing Layer): | |
| Gelatin | 0.59 |
| UV Absorbent (UV-1) | 0.37 |
| Color Image Stabilizer (Cpd-5) | 0.02 |
| Color Image Stabilizer (Cpd-12) | 0.10 |
| Solvent (Solv-3) | 0.05 |
| Seventh Layer (Protective Layer): | |
| Gelatin | 1.13 |
| Acryl-modified Copolymer of Polyvinyl Alcohol (modification degree 17%) | 0.05 |
| Liquid Paraffin | 0.02 |
| Surfactant (Cpd-13) | 0.01 |

The compound used above are mentioned below.

(ExY) Yellow Coupler:
1/1 (by mol) mixture of the following:

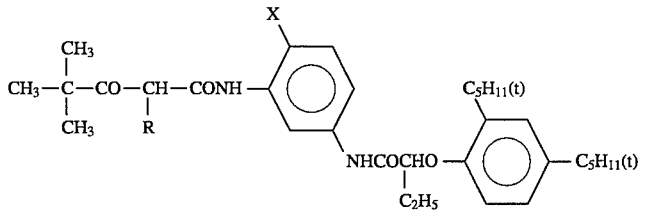

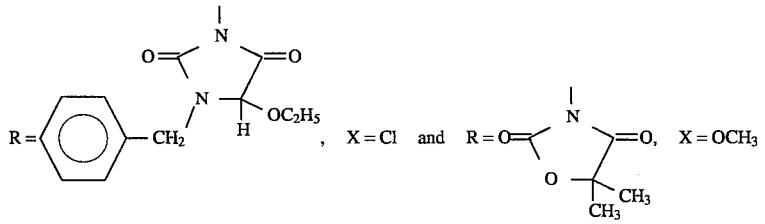

(ExC) Cyan Coupler:
25/75 (by mol) mixture of the following:

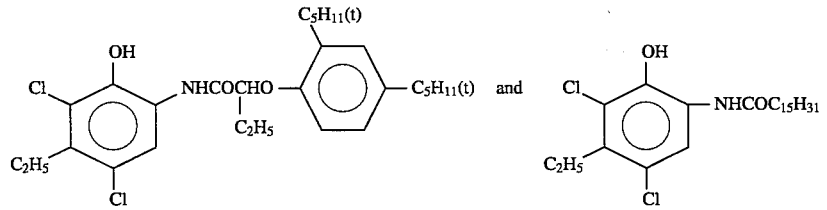

-continued
(Cpd-1) Color Image Stabilizer
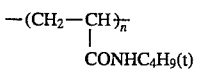
mean molecular weight: 60,000
(Cpd-2) Color Image Stabilizer
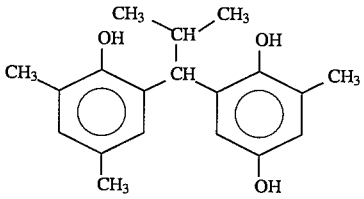
(Cpd-3) Color Image Stabilizer
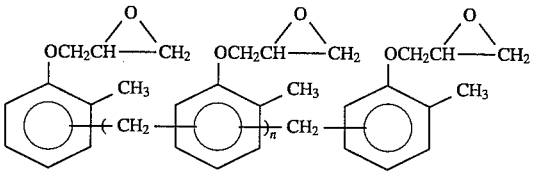
n = 7 to 8 (mean value)
(Cpd-4) Color Mixing Preventing Agent:
1/1 (by weight) mixture of the following:
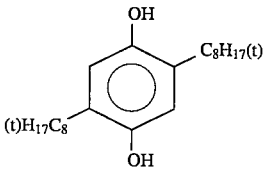
and
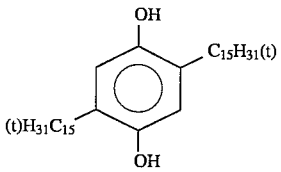
(Cpd-5) Color Image Stabilizer:
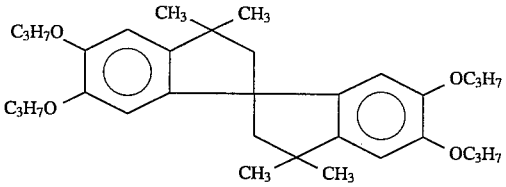
(Cpd-6) Color Image Stabilizer:
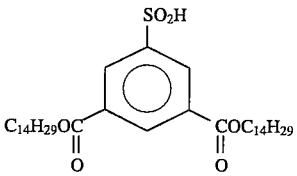
(Cpd-7) Color Image Stabilizer:
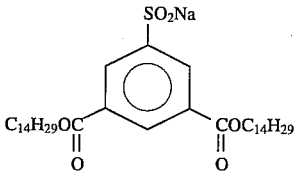
(Cpd-8) Color Image Stabilizer:

-continued
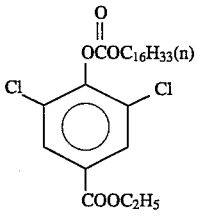
(Cpd-9) Color Image Stabilizer:
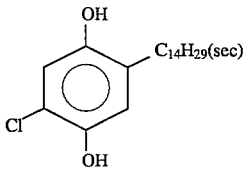
(Cpd-10) Color Image Stabilizer:
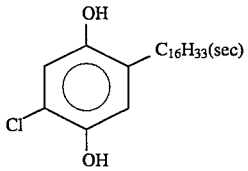
(Cpd-11) Color Image Stabilizer:
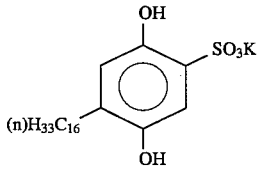
(Cpd-12) Color Image Stabilizer:
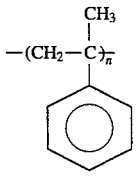
n = about 20 (as average number)
(Cpd-13) Color Image Stabilizer:
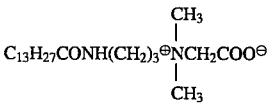
(Cpd-14) Antiseptic:
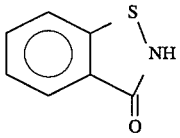
(Cpd-15) Antiseptic:
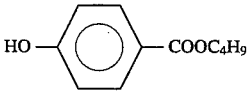
(UV-1) UV Absorbent:

-continued
1/2/1/2/3 mixture (by weight) of the following (1), (2), (3), (4) and (5):
(1)
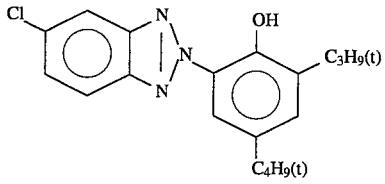
(2)
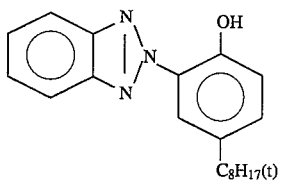
(3)
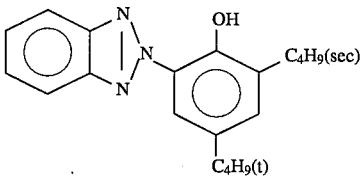
(4)
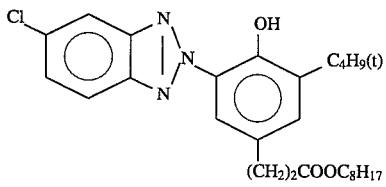
(5)
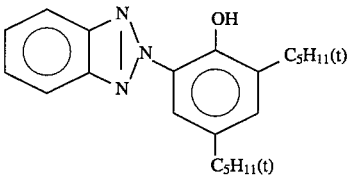
(UV-2) UV Absorbent:
1/1/2/2 mixture (by weight) of the following (1), (2), (3) and (4):
(1)
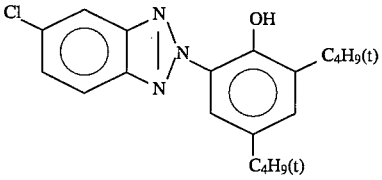
(2)
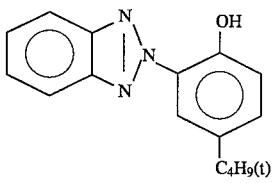
(3)
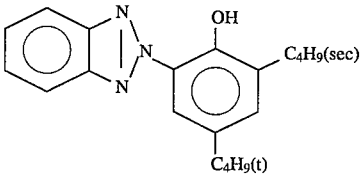
(4)
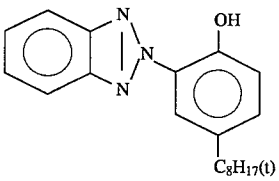
(UV-3) UV Absorbent:
2/3/1 mixture (by weight) of the following (1), (2) and (3):
(1)
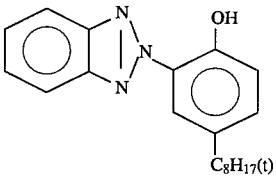
(2)
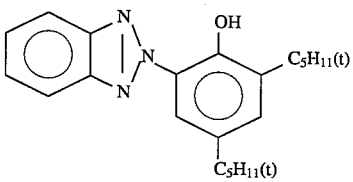

-continued (3)

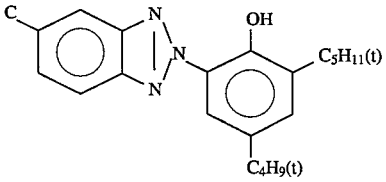

(Solv-1) Solvent:

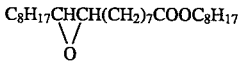

(Solv-2) Solvent:

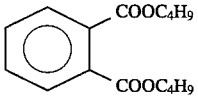

(Solv-3) Solvent:

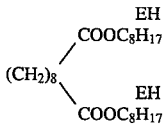

(Solv-4) Solvent:

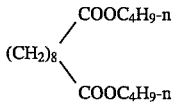

(Solv-5) Solvent:

(Solv-6) Solvent:

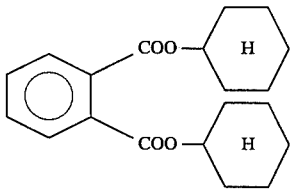

(Solv-7) Solvent:

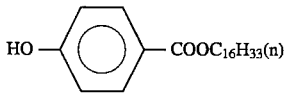

The samples thus prepared were exposed and processed in the manner mentioned below.

Precisely, these were subjected to gradient exposure via a gradient wedge having a three-color separating sensitometric filter, using a sensitometer (FWH Model, manufactured by Fuji Photo Film Co.—its light source has a color temperature of 3200° K). One-second exposure gave 250 CMS.

Using a paper processing machine, the thus-exposed samples were continuously processed according to the color development process mentioned below until the amount of the replenisher to the color developer tank became 2 times the tank capacity.

| | Processing Steps: | | | |
|---|---|---|---|---|
| Step | Temp. | Time | Replenisher (ml) (*) | Tank Capacity (liter) |
| Color Development | 35° C. | 45 sec | 161 | 17 |
| Bleach-Fixation | 35° C. | 45 sec | 215 | 17 |
| Stabilization (1) | 35° C. | 20 sec | — | 10 |
| Stabilization (2) | 35° C. | 20 sec | — | 10 |
| Stabiliza- | 35° C. | 20 sec | — | 10 |

-continued

| Step | Temp. | Processing Steps: Time | Replenisher (ml) (*) | Tank Capacity (liter) |
|---|---|---|---|---|
| tion (3) | | | | |
| Stabiliza-tion (4) | 35° C. | 20 sec | 248 | 10 |
| Drying | 80° C. | 60 sec | | |

(*) This is an amount of the replenisher per $m^2$ of the photographic paper sample being processed.

The stabilization was effected according to the 4-tank countercurrent cascade system from tank (4) to tank (1).

The processing solutions used above are mentioned below.

| | Tank Solution | Replenisher |
|---|---|---|
| Color Developer: | | |
| Water | 800 ml | 800 ml |
| Lithium Polystyrenesulfonate Solution (30%) | 0.25 ml | 0.25 ml |
| 1-Hydroxyethylidene-1,1-diphosphonic Acid Solution (60%) | 0.8 ml | 0.8 ml |
| Lithium Sulfate (Anhydride) | 2.7 g | 2.7 g |
| Triethanolamine | 8.0 g | 8.0 g |
| Potassium Chloride | 1.8 g | — |
| Potassium Bromide | 0.03 g | 0.025 g |
| Diethylhydroxylamine | 4.6 g | 7.2 g |
| Glycine | 5.2 g | 8.1 g |
| Threonine | 4.1 g | 6.4 g |
| Potassium Carbonate | 27 g | 27 g |
| Potassium Sulfite | 0.1 g | 0.2 g |
| N-ethyl-N-(β-methanesulfonamido-ethyl)-3-methyl-4-aminoaniline 3/2 Sulfate Monohydrate | 4.5 g | 7.3 g |
| Brightening Agent (4,4'-diaminostilbene compound) | 2.0 g | 3.0 g |
| Water to make | 1000 ml | 1000 ml |
| pH (adjusted with potassium hydroxide and sulfuric acid) | 10.12 | 10.70 |
| Bleach-fixing Solution: Both the tank solution and the replenisher were same. | | |
| Water | 400 ml | |
| Ammonium Thiosulfate (70%) | 100 ml | |
| Sodium Sulfite | 17 g | |
| Ammonium Ethylenediaminetetraacetato/iron(III) | 55 g | |
| Disodium Ethylenediaminetetraacetate | 5 g | |
| Glacial Acetic Acid | 9 g | |
| Water to make | 1000 ml | |
| pH (25° C.) (adjusted with acetic acid and ammonia) | 5.40 | |
| Stabilizer: Both the tank solution and the replenisher were same. | | |
| 1,2-Benzisothiazolin-3-one | 0.02 g | |
| Polyvinyl Pyrrolidone | 0.05 g | |
| Water to make | 1000 ml | |
| pH | 7.0 | |

The thus-processed samples were exposed to xenon (100,000 luxes) for 20 days, using a xenon tester. The degree of fading of the magenta dye was measured at the point having an initial magenta density of 1.5 and at the point having an initial magenta density of 0.5. In addition, the Y-stains formed after the exposure were measured in the same manner as in Example 1. The test results are shown in Table 2 below.

TABLE 2

| Sample No. | Coupler of Formula (I)(*1) | Magenta Compound of Formula (II)(*2) | Degree of Fading of Magenta Dye Formed: at initial density of 0.5 | at initial density of 1.5 | Y-stains | Remarks |
|---|---|---|---|---|---|---|
| 201 | M-15 | — | 31 | 20 | 0.19 | comparative sample |
| 202 | M-15 | UV-2 | 18 | 19 | 0.06 | sample of the invention |
| 203 | M-15 | UV-5 | 18 | 18 | 0.05 | sample of the invention |
| 204 | M-15 | UV-9 | 17 | 18 | 0.06 | sample of the invention |
| 205 | M-15 | UV-2 (added to 5th layer) | 30 | 20 | 0.18 | comparative sample |
| 206 | M-36 | — | 51 | 12 | 0.21 | comparative sample |
| 207 | M-36 | UV-2 | 11 | 11 | 0.05 | sample of the invention |
| 208 | M-36 | UV-5 | 11 | 11 | 0.04 | sample of the invention |
| 209 | M-36 | UV-9 | 10 | 11 | 0.04 | sample of the invention |
| 210 | M-36 | UV-10 | 10 | 10 | 0.05 | sample of the invention |
| 211 | M-36 | UV-23 | 10 | 10 | 0.05 | sample of the invention |
| 212 | M-36 | UV-23 (added to 5th layer) | 48 | 12 | 0.06 | comparative sample |

(*1)Amount of coupler of formula (I) coated was 0.14 g/$m^2$.
(*2)Amount of compound of formula (II) coated was 0.12 g/$m^2$.

From the results in Table 2 above, it is understood that, in the photographic material samples of the present invention, the magenta dye formed had excellent light fastness all the way from its low density area to its high density area and that the amount of the Y-stains formed was extremely small. It is also understood therefrom that the effect could not be attained when the compound of formula (II) was not incorporated into one and the same layer along with the magenta coupler of formula (I).

Since the formation of Y-stains was inhibited more effectively when the compound of formula (II) was incorporated into one and the same layer along with the coupler of formula (I) but not into the layer upper than the layer containing the coupler of formula (I), it is understood that the compounds of formula (II) are not ones which merely cut UV rays.

As described in detail hereinabove, the present invention provides a color photographic material having excellent color reproducibility. The material may form a magenta color image having high light fastness all the way from its low density area to its high density area, and the formation of Y-stains in the material is extremely small.

Of couplers of formula (I), those of formula (If) are especially preferred.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, said at least one silver halide emulsion layer contains at least one compound of the following general formula (I) and at least one compound of the following general formula (II):

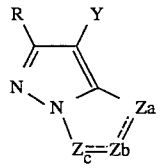

(I)

wherein R represents a hydrogen atom, an aliphatic group, an aromatic group, a heterocyclic group, R'''O—, R'''C(=O)—, R'''CO(=)—, R'''S—, R'''SO—, R'''$SO_2$—, R'''$SO_2$NH—, R'''C(=O)NH—, R'''NH—, R'''OC(=O)NH—, a halogen atom, a cyano group, an imido group, a carbamoyl group, a sulfamoyl group, an ureido group or a sulfamoylamino, and R''' is an alkyl group, an aryl group or a heterocyclic group;

Za, Zb and Zc each represent a methine group, =N—, —NH—, or a substituted methine group wherein the substituents are an aliphatic group, an aromatic group, a heterocyclic group, R'''O—, R'''C(=O)—, R'''CO(=O)—, R'''S—, R'''SO—, R'''$SO_2$, R'''$SO_2$NH—, R'''C(=O)NH—, R'''NH—, R'''OC(=O)NH—, a halogen atom, a cyano group, an imido group, a carbamoyl group, a sulfamoyl group, an ureido group or a sulfamoylamino group, and R''' is an alkyl group, an aryl group or a heterocyclic group;

Y represents a hydrogen atom or a group capable of splitting off from the formula by coupling reaction with an oxidation product of a developing agent; and the formula may form a dimer or a higher polymer via R, Y or the substituted methine group for Za, Zb or Zc;

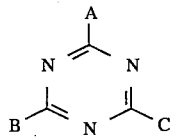

(II)

wherein A, B and C each represents an alkyl group, an aryl group, an alkoxy group, an aryloxy group or a heterocyclic group, provided that at least one of A, B and C represents a group of a general formula (III):

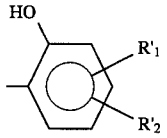

(III)

wherein $R_1'$ and $R_2'$ each represents a hydrogen atom, a halogen atom, an alkyl group, a cycloalkyl group, an aryl group, an alkoxy group or an aryloxy group.

2. The silver halide color photographic material as claimed in claim 1, wherein R represents a hydrogen atom, an aliphatic group, an aromatic group, a heterocyclic group, R'''O—, R'''C(=O)—, R'''CO(=O)—, R'''S—, R'''SO—, R'''$SO_2$—, R'''$SO_2$NH—, R'''C(=O)NH—, R'''NH—, R'''OC(=O)NH— (wherein R''' represents an alkyl group, an aryl group or a heterocyclic group), a halogen atom, a cyano group, an imido group, a carbamoyl group, a sulfamoyl group, an ureido group or a sulfamoylamino group, Y represents a hydrogen atom, a halogen atom, an alkoxy group, an aryloxy group, an acyloxy group, an aliphatic or aromatic sulfonyloxy group, an acylamino group, an aliphatic or aromatic sulfonamido group, an alkoxycarbonyloxy group, an aryloxycarbonyloxy group, an aliphatic, aromatic or heterocyclic thio group, a carbamoylamino group, a 5-membered or 6-membered nitrogen-containing heterocyclic group, an imido group or an aromatic azo group.

3. The silver halide color photographic material as claimed in claim 1, wherein A, B and C each represent an aryl group, an alkoxy group or a group of formula (III):

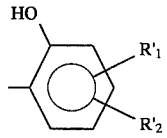

(III)

wherein $R_1'$ and $R_2'$ each represent a hydrogen atom, a halogen atom, an alkyl group, a cycloalkyl group, an aryl group, an alkoxy group or an aryloxy group.

4. The silver halide color photographic material as claimed in claim 1, wherein said photographic constitutive layer contains the compound of formula (I) and compound of formula (II) in a form of emulsified dispersion which is obtained by dissolving the compound of formula (I) in a high boiling point organic solvent along with the compound of formula (II) to be co-emulsified.

5. The silver halide color photographic material as claimed in claim 4, wherein said photographic constitutive layer is a layer comprising a light-sensitive silver halide emulsion.

6. The silver halide color photographic materials claimed in claim 5, said light-sensitive silver halide emulsion is a silver chlorobromide emulsion containing 90 mol % or more of silver chloride or a silver chloride emulsion, which contains substantially no silver iodide.

7. The silver halide color photographic material as claimed in claim 1, wherein the coupler of formula (I) is selected from among compounds of formulae (Ia), (Ib), (Ic), (Id) and (Ie):

(Ia)

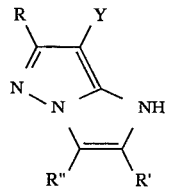

(Ib)

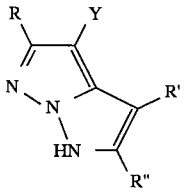

(Ic)

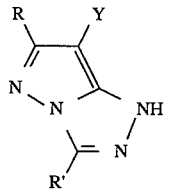

(Id)

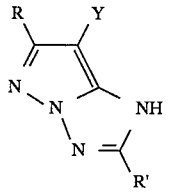

(Ie)

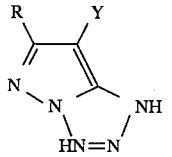

wherein R, R' and R" each represent an aliphatic group, an aromatic group, an heterocyclic group, R'''O—, R'''C(=O)—, R'''CO(=O)—, R'''S—, R'''SO—, R'''$SO_2$—, R'''$SO_2$NH—, R'''C(=O)NH—, R'''NH—, R'''OC(=O)NH— (R''' being an alkyl group, an aryl group or a heterocyclic group), a hydrogen atom, a halogen atom, a cyano group, an imido group, a carbamoyl group, a sulfamoyl group, an ureido group or a sulfamoylamino group; and Y has the same meaning as that in formula (I).

8. The silver halide photographic material as claimed in claim 1, wherein the coupler of formula (I) is a compound of a general formula (If):

(If)

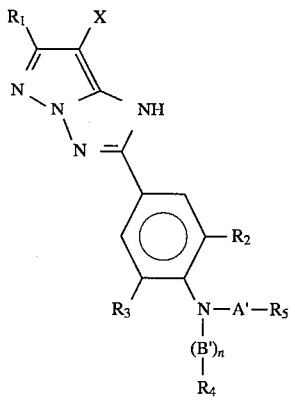

wherein $R_1$ represents a tertiary alkyl group; $R_2$ and $R_3$ each represent a hydrogen atom or a substituent; X represents a halogen atom or an aryloxy group; A' and B' each represent —CO— or —$SO_2$—; n represents 0 or 1; $R_4$ represents a hydrogen atom, an alkyl group or an aryl group; $R_5$ represents an alkyl group, an aryl group, an alkoxy group, an alkylamino group or an arylamino group; and $R_4$ and $R_5$ may be bonded to each other to form a 5-membered, 6-membered or 7-membered ring.

9. The silver halide color photographic material as claimed in claim 8, wherein said compound of formula (If) is contained in the photographic constitutive layer in a form of emulsified dispersion which is obtained by dissolving the compound of formula (If) in a high boiling point organic solvent along with the compound of formula (II) to be co-emulsified.

10. The silver halide color photographic material as claimed in claim 9, wherein said photographic constitutive layer is a layer comprising a light-sensitive silver halide emulsion.

11. The silver halide color photographic material as claimed in claim 10, said light-sensitive silver halide emulsion is silver chlorobromide emulsion containing 90 mol % or more of silver chloride or a silver chloride emulsion, which contains substantially no silver iodide.

12. The silver halide color photographic material as claimed in claim 1, wherein the compound of the general formula (I) is used in an amount of $1\times10^{-3}$ mol to 1 mol per mol of the silver halide.

13. The silver halide color photographic material as claimed in claim 1, wherein the compound of the general formula (II) is used in an amount of 1 to 300% by weight relative to the compound of the general formula (I).

14. The silver halide photographic material as claimed in claim 1, wherein the coupler of formula (I) is a compound of a general formula (If):

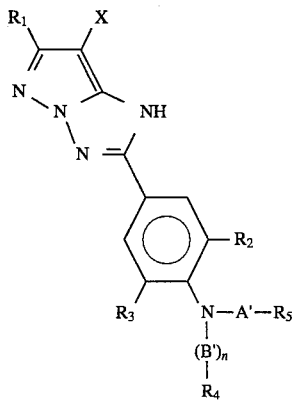

(If)

wherein $R_1$ represents a tertiary alkyl group; $R_2$ and $R_3$ each represent a hydrogen atom, a cyano group, a hydroxyl group, a carboxyl group, a halogen atom, an alkyl group, an aryl group, an alkoxy group, an aryloxy group, an alkoxycarbonyl group, a carbamoyl group, a carbonamido group, a sulfonamido group, and a sulfamoyl group; X represents a halogen atom or an aryloxy group; A' and B' each represent —CO— or —$SO_2$—; n represents 0 or 1; $R_4$ represents a hydrogen atom, an alkyl group or an aryl group; $R_5$ represents an alkyl group, an aryl group, an alkoxy group, an alkylamino group or an arylamino group; and $R_4$ and $R_5$ may be bonded to each other to form a 5-membered, 6-membered or 7-membered ring.

15. The silver halide color photographic material as claimed in claim 1, wherein R is an aliphatic group having 1 to 32 carbon.

16. The silver halide color photographic material as claimed in claim 1, wherein R is an aromatic group having 6 to 32 carbon atoms.

17. The silver halide color photographic material as claimed in claim 1, wherein R is a heterocyclic group having a 5 or 6-membered ring containing at least one nitrogen, oxygen or sulfur atom.

18. The silver halide color photographic material as claimed in claim 1, wherein R is an aliphatic group, aromatic group or heterocyclic group substituted by an alkyl group having 1 to 32 carbon atoms, an aryl group having 6 to 32 carbon atoms, a heterocyclic group, an alkoxy group, an aryloxy group, an alkenyloxy group, an acyl group, an ester group, an amido group, a carbamoyl group, a sulfamoyl group, an imido group, an ureido group, an aliphatic or aromatic sulfonyl group, an aliphatic or aromatic thio group, a hydroxyl group, a cyano group, a carboxyl group, a nitro group, a sulfo group, or a halogen atom.

19. The silver halide color photographic material as claimed in claim 7, wherein the coupler of formula (I) is a compound of formula (Ic) or (Id).

20. The silver halide color photographic material as claimed in claim 19, wherein R is a tertiary alkyl group and R' is an alkyl group or an aryl group.

21. The silver halide color photographic material as claimed in claim 8, wherein $R_5$ represents an alkyl group having 1 to 32 carbon atoms, an aryl group having 6 to 32 carbon atoms, an alkoxy group having 1 to 32 carbon atoms, an alkylamino group having 1 to 32 carbon atoms or an arylamino group having 6 to 32 carbon atoms.

22. The silver halide color photographic material as claimed in claim 8, wherein $R_1$ is substituted by a halogen atom, an alkoxy group, an aryloxy group, an alkylthio group, an arylthio group, an ester group, or a cyano group.

23. The silver halide color photographic material as claimed in claim 8, wherein $R_1$ is a t-butyl group.

24. The silver halide color photographic material as claimed in claim 8, wherein $R_2$ and $R_3$ are both hydrogen atoms.

25. The silver halide color photographic material as claimed in claim 8, wherein $R_4$ is a substituted alkyl group or a substituted aryl group and $R_5$ is substituted, and the substituents are a halogen atom, a hydroxyl group, a cyano group, a carboxyl group, an aryl group, an alkoxy group, an aryloxy group, an alkylthio group, an arylthio group, an carbonyloxy group, an amido group, a sulfonamido group, a carbamoyl group, a sulfamoyl group, an imido group, an urethane group, an ureido group, or a sulfonyl group.

26. The silver halide color photographic material as claimed in claim 1, wherein A, B or C represents an alkyl group having 1 to 20 carbon atoms, an alkoxy group having 1 to 20 carbon atoms, an aryl group having 6 to 20 carbon atoms or an aryloxy group having 6 to 20 carbon atoms.

27. The silver halide color photographic material as claimed in claim 1, wherein A, B or C is a substituted alkyl group, a substituted aryl group, a substituted alkoxy group or a substituted heterocyclic group which are each independently substituted by a hydroxyl group, a halogen atom, an alkyl group having 1 to 12 carbon atoms, an alkoxy group having 1 to 18 carbon atoms, an aryloxy group having from 6 to 18 carbon atoms, an alkoxycarbonyl group, an aryloxycarbonyl group, an alkylthio group having from 1 to 18 carbon atoms or a carbamoyl group.

* * * * *